US012247792B2

(12) United States Patent
Zhang et al.

(10) Patent No.: US 12,247,792 B2
(45) Date of Patent: Mar. 11, 2025

(54) HEAT EXCHANGER

(71) Applicant: Hangzhou Sanhua Research Institute Co., Ltd., Zhejiang (CN)

(72) Inventors: Weiwei Zhang, Zhejiang (CN); Junqi Dong, Zhejiang (CN); Xin Shi, Zhejiang (CN)

(73) Assignee: Hangzhou Sanhua Research Institute Co., Ltd., Zhejiang (CN)

( * ) Notice: Subject to any disclaimer, the term of this patent is extended or adjusted under 35 U.S.C. 154(b) by 500 days.

(21) Appl. No.: 17/606,741

(22) PCT Filed: Jun. 3, 2020

(86) PCT No.: PCT/CN2020/094196
§ 371 (c)(1),
(2) Date: Oct. 26, 2021

(87) PCT Pub. No.: WO2020/244555
PCT Pub. Date: Dec. 10, 2020

(65) Prior Publication Data

US 2022/0214113 A1 Jul. 7, 2022

(30) Foreign Application Priority Data

Jun. 3, 2019 (CN) ..... 201920823527.2
Aug. 1, 2019 (CN) ..... 201910708129.0
Aug. 1, 2019 (CN) ..... 201910708951.7

(51) Int. Cl.
*F28D 7/16* (2006.01)
*F28F 1/00* (2006.01)
*F28F 9/02* (2006.01)

(52) U.S. Cl.
CPC ..... *F28D 7/16* (2013.01); *F28F 1/006* (2013.01); *F28F 9/02* (2013.01)

(58) Field of Classification Search
CPC ..... F28D 7/16; F28F 1/006; F28F 9/02
(Continued)

(56) References Cited

U.S. PATENT DOCUMENTS 5,477,919 A * 12/1995 Karube ..... F28F 9/0212 165/178
5,630,326 A * 5/1997 Nishishita ..... F16L 39/00 62/299

(Continued)

FOREIGN PATENT DOCUMENTS

CN 1692265 A 11/2005
CN 1875239 A 12/2006

(Continued)

OTHER PUBLICATIONS

Extended European Search Report in Application No. 20817984.6 dated May 8, 2023 in 6 pages.

(Continued)

*Primary Examiner* — Claire E Rojohn, III
(74) *Attorney, Agent, or Firm* — Knobbe, Martens, Olson & Bear, LLP

(57) ABSTRACT

Disclosed is a heat exchanger. An end cover is assembled and fixed to a port of a first header in a lengthwise direction or a port of a second header in a lengthwise direction, and the end cover includes a body and a first opening formed in the body. The body includes a second cavity and a first recess. The first recess includes a first bottom wall close to the first opening, the first bottom wall is provided with a third opening, the third opening is in communication with the first opening and the second cavity, and the first opening is farther away from an inner cavity of the first header or an inner cavity of the second header than the second cavity. The open area of the first recess is larger than that of the third opening.

21 Claims, 26 Drawing Sheets

(58) Field of Classification Search
USPC ..... 165/175
See application file for complete search history.

(56) References Cited

U.S. PATENT DOCUMENTS

| | | | | |
|---|---|---|---|---|
| 6,196,306 | B1 * | 3/2001 | Aikawa | F28F 9/0253 165/178 |
| 6,543,530 | B2 * | 4/2003 | Watanabe | F28F 9/0253 165/178 |
| 6,776,225 | B2 * | 8/2004 | Leitch | F28D 1/0325 165/173 |
| 7,174,953 | B2 * | 2/2007 | Chiba | F28F 9/0253 165/178 |
| 7,219,717 | B2 * | 5/2007 | Hanafusa | F25B 39/022 165/174 |
| 7,926,854 | B2 * | 4/2011 | Sharma | F28F 9/0253 165/178 |
| 8,186,719 | B2 * | 5/2012 | Kume | F28F 9/0246 165/176 |
| 8,851,158 | B2 * | 10/2014 | Alahyari | F28F 9/0217 165/174 |
| 9,844,997 | B2 * | 12/2017 | Baek | B60H 1/00557 |
| 9,885,432 | B2 * | 2/2018 | Lemee | F16L 13/02 |
| 9,921,002 | B2 * | 3/2018 | Suzuki | H01L 23/473 |
| 10,066,878 | B2 * | 9/2018 | Huang | F25B 40/00 |
| 2003/0066633 | A1 * | 4/2003 | Lee | F28D 1/05391 165/175 |
| 2005/0247443 | A1 * | 11/2005 | Kim | F28D 1/05391 165/176 |
| 2007/0006460 | A1 * | 1/2007 | Kim | B21D 53/02 165/173 |
| 2007/0215331 | A1 * | 9/2007 | Higashiyama | F25B 39/022 165/41 |
| 2009/0266104 | A1 * | 10/2009 | Ichiyanagi | F28F 9/0253 165/173 |
| 2015/0053376 | A1 * | 2/2015 | Matsumoto | B60H 1/00328 165/144 |
| 2015/0053383 | A1 * | 2/2015 | Citti | F28D 1/05375 165/173 |
| 2015/0292817 | A1 * | 10/2015 | Shimanuki | F28D 1/05366 165/173 |
| 2016/0138871 | A1 * | 5/2016 | Matsumoto | F28F 9/028 62/526 |
| 2021/0033343 | A1 * | 2/2021 | Dong | F28F 9/0221 |
| 2021/0041189 | A1 * | 2/2021 | Dong | B60H 1/00335 |
| 2022/0214113 | A1 * | 7/2022 | Zhang | F28F 1/025 |
| 2023/0092584 | A1 * | 3/2023 | Tarui | F25B 39/02 165/153 |

FOREIGN PATENT DOCUMENTS

| | | | |
|---|---|---|---|
| CN | 101158525 | A | 4/2008 |
| CN | 101315230 | A | 12/2008 |
| CN | 102778165 | A | 11/2012 |
| CN | 103162090 | A | 6/2013 |
| CN | 103423525 | A | 12/2013 |
| CN | 104567110 | A | 4/2015 |
| CN | 204313694 | U | 5/2015 |
| CN | 204329411 | U | 5/2015 |
| CN | 204388688 | U | 6/2015 |
| CN | 106066128 | A | 11/2016 |
| CN | 107314691 | A | 11/2017 |
| CN | 208595829 | U | 3/2019 |
| DE | 112007002084 | T5 | 8/2009 |
| EP | 1420223 | B1 | 1/2005 |
| FR | 2833920 | A1 | 6/2003 |
| JP | 4340937 | B2 | 10/2009 |
| KR | 100723810 | B1 | 5/2007 |
| KR | 101438310 | B1 | 9/2014 |
| RU | 2469252 | C1 | 12/2012 |
| WO | 2012041441 | A2 | 4/2012 |

OTHER PUBLICATIONS

Non-Final Office Action received in Chinese Application No. 2021052702087490, dated Jun. 1, 2021 in 7 pages.
Non-Final Office Action received in Chinese Application No. 2021080501846370, dated Aug. 10, 2021 in 7 pages.
Non-Final Office Action received in Chinese Application No. 2021061502021510, dated Jun. 18, 2021 in 8 pages.
International Search Report received in PCT/CN2019/107089517 dated Aug. 1, 2019 in 1 page.
International Search Report received in PCT/CN2020/094196 dated Aug. 5, 2020 in 8 pages.
International Search Report received in PCT/CN2019/107081290 dated Aug. 1, 2019 in 1 page.
Third Office Action of Chinese Application No. 201910708129.0, dated Dec. 2, 2021 in 19 pages.
Engineering Thermodynamics, p. 171.
Tien, Ji-Lang et al., "Research on the Principle of Chemical Process and Its Treatment Method", China Atomic Energy Publication, Nov. 26, 2021, in 6 pages.

* cited by examiner

HEAT EXCHANGER

TECHNICAL FIELD

The present disclosure relates to the field of heat exchange technology, and in particular, to a heat exchanger.

BACKGROUND

Heat exchangers are widely used in heat exchange systems such as air conditioning systems. The heat exchanger includes heat exchange tubes and a header. The refrigerant flows into the header, and then flows from the header to the heat exchange tube to exchange heat with external environment.

The header assembly includes an end cap. In a heat exchanger using $CO_2$ as the refrigerant, a high pressure would be generated when the refrigerant flows from the end cap to the header due to a high system pressure. Thus, the header is required to have relatively high pressure resistance performance.

SUMMARY

The present disclosure provides a heat exchanger, which has good pressure resistance performance.

A first aspect of the present disclosure provides a heat exchanger that includes a first header, a second header, heat exchange tubes, and an end cap. Each of the heat exchange tubes has an end connected to the first header and another end connected to the second header. Inner cavities of the heat exchange tubes communicate an inner cavity of the first header with an inner cavity of the second header, and each of the first header and the second header includes two ports disposed in a length direction thereof.

The end cap is assembled and fixed to one port of the two ports of the first header or one port of the two ports of the second header. The end cap includes a body and a first opening formed in the body. The body includes a second cavity and a first groove portion. The first groove portion is located between the first opening and the second cavity.

The first groove portion includes a first bottom wall close to the first opening. The first bottom wall is provided with a third opening communicating the first opening with the second cavity. The second cavity is in communication with the inner cavity of the first header or the inner cavity of the second header. The first opening is located farther from the inner cavity of the first header or the inner cavity of the second header than the second cavity, and the first opening is configured for inflow or outflow of a refrigerant.

A flow area of the first groove portion is greater than a flow area of the third opening, such that an instantaneous pressure of the refrigerant can be reduced after the refrigerant flows from the first opening into a cavity of the first groove portion through the third opening. In this way, impact of the refrigerant flowing into the headers on the headers can be reduced to reduce the pressure resistance requirement of the headers.

It should be understood that the above general description and the following detailed description are only exemplary, but are not intended to limit the present disclosure thereto.

The drawings are incorporated into the description herein and constitute a part thereof, showing embodiments of the present disclosure. The drawings are illustrated in conjunction with the description to explain the principle of the present disclosure.

DESCRIPTION OF EMBODIMENTS

Embodiments of the present disclosure will be described in detail hereinafter with reference to the accompanying drawings in order to make objections, technical solutions and advantages of the present disclosure clearer. It should be understood that the embodiments described below are merely some of, rather than all of the embodiments of the present disclosure. Based on the embodiments of the present disclosure, all other embodiments made by those skilled in the art without any inventive step shall fall within the scope of the present disclosure.

First Embodiment

Figure 1:
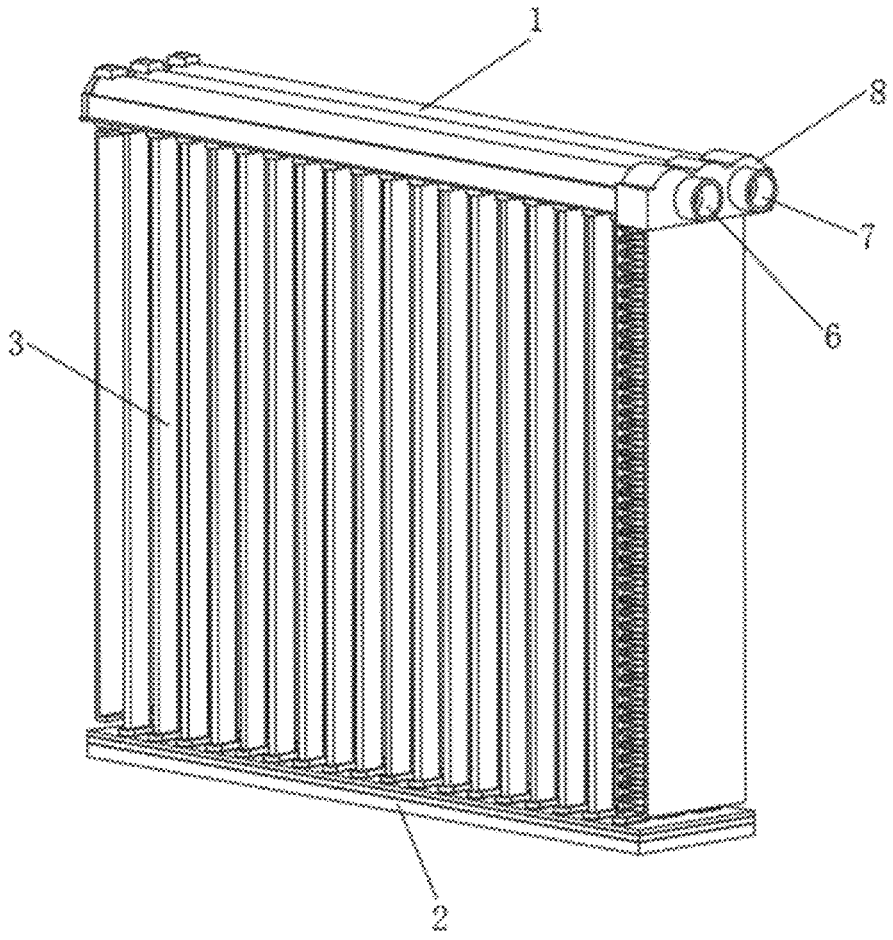
FIG. 1 is a schematic structural view of a heat exchanger according to a first embodiment of the present disclosure.
Figure 2:
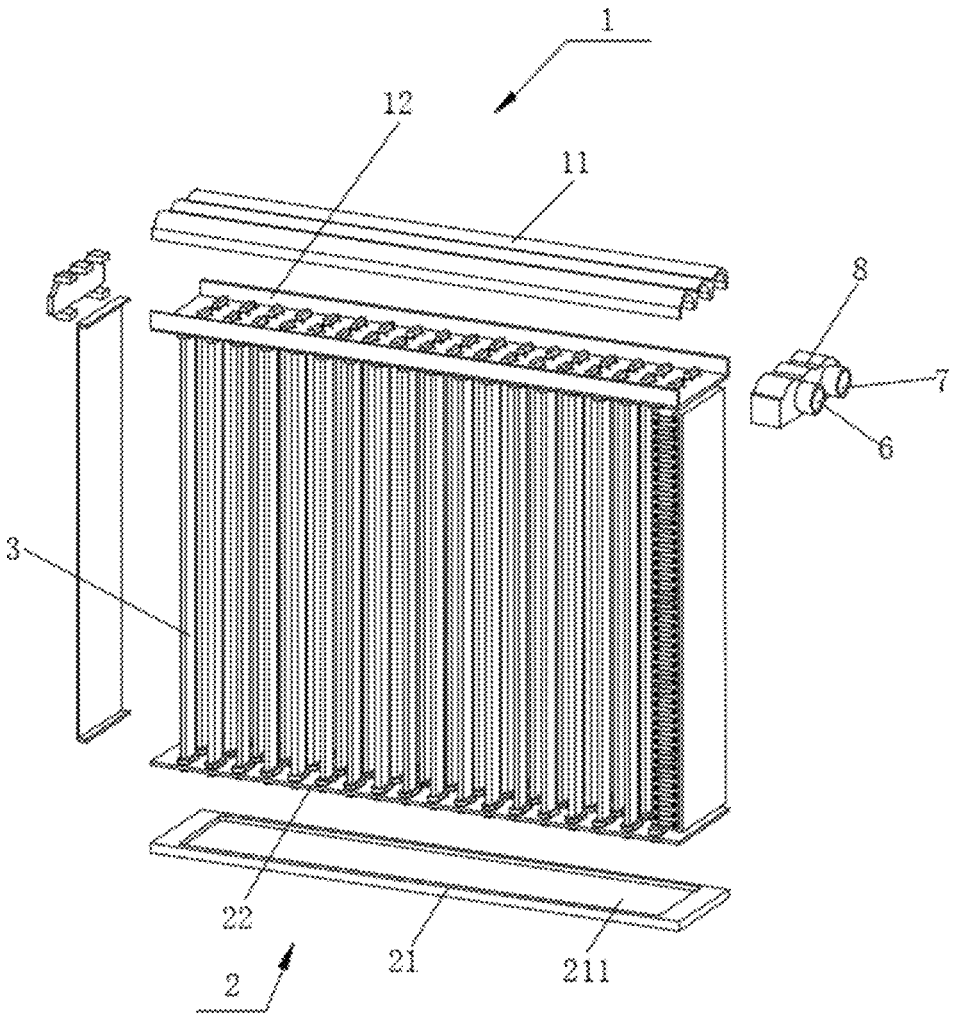
FIG. 2 is an exploded view of the heat exchanger according to the first embodiment of the present disclosure.

The first embodiment of the present disclosure provides a heat exchanger. As shown in FIGS. 1 and 2, the heat exchanger includes a first header 1, a plurality of rows of heat exchange tubes 3, and a second header 2, which are arranged sequentially from top to bottom.

Figure 3:
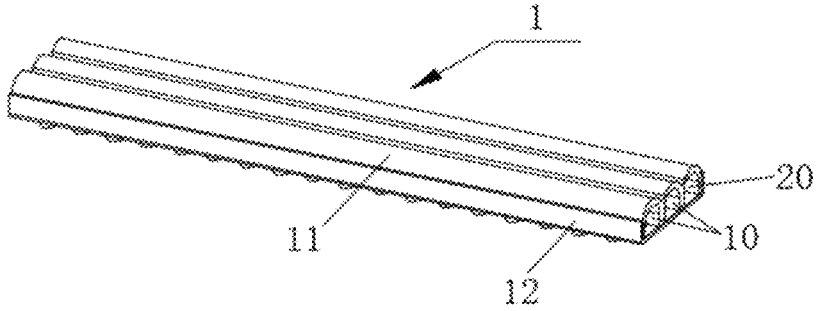
FIG. 3 is a schematic structural view of a first header according to the first embodiment of the present disclosure.

Referring to FIG. 3, the first header 1 includes a first main plate 11 and a second main plate 12 located below the first main plate 11. The first main plate 11 and the second main plate 12 are assembled to form the first header 1. It should be understood that the first main plate 11 and the second main plate 12 may be two parts of one component, or may be a single piece formed by assembling two separated components. Alternatively, the second main plate 12 and the first main plate 11 are fixed together by brazing.

The first main plate 11 includes at least one middle rib 111 that is supported on the second main plate 12 and is capable of dividing the first main plate 11 into a plurality of through grooves 112. The through grooves 112 extend in a direction parallel to a longitudinal direction of the first header 1. A circulation cavity is formed between the second main plate 12 and each of the through grooves 112, and adjacent circulation cavities are arranged in parallel with each other in a direction perpendicular to an axial direction of the first header 1. In this embodiment, a cross section of each of the through grooves 112 may be in a semicircular, semi-elliptical, or rectangular shape, etc., and may also be in other shapes capable of forming the through grooves 112. Moreover, each of the through grooves 112 may be the same or different from each other in volume.

At least one of the circulation cavities forms a first flow passage 10, and at least one of the circulation cavities forms a second flow passage 20. It should be noted that, in this embodiment, the first flow passage 10 communicates with a first flow port 6, and the second flow passage 20 communicates with a second flow port 7. In a case where the heat exchanger is used as a condenser, a high-temperature gaseous heat transfer medium is capable of flowing from the first flow port 6 into the first flow passage 10, circulating in the heat exchange tubes 3 to exchange heat therein, and then flowing out of the second flow port 7 through the second flow passage 20 (In this case, the heat transfer medium is in a liquid state or a gas-liquid mixed state). In a case where the heat exchanger is an evaporator, the heat transfer medium in the liquid state is capable of flowing from the second flow port 7 into the second flow passage 20, circulating in the heat exchange tubes 3 to exchange heat therein, and then flowing out of the first flow port 6 through the first flow passage 10 (In this case, the heat transfer medium is in the gaseous state). A total volume of the first flow passages 10, i.e., a sum of the volumes of all the first flow passages 10, is greater than that of the second flow passages 20, i.e., a sum of the volumes of the second flow passages 20. With this configuration, the heat transfer medium for heat exchange can flow at a relatively high flow rate in the heat exchanger.

Alternatively, in this embodiment, the heat exchanger may include at least two first flow passages 10 and at least one second flow passage 20. Further, all of the at least two first flow passages 10 are located at the same side of the second flow passage 20 to facilitate inflow of the heat transfer medium.

Figure 4:
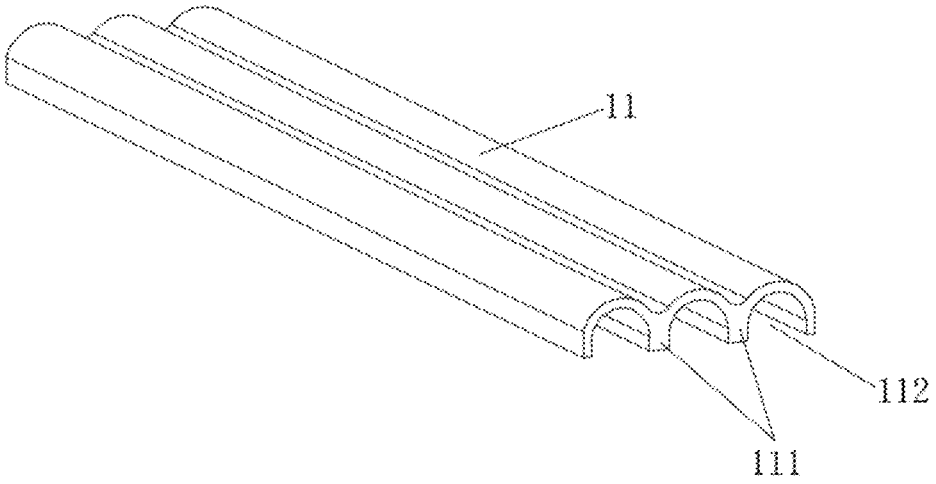
FIG. 4 is a schematic view of a first main plate with a middle rib that is not formed with a hole or opening, according to the first embodiment of the present disclosure.

Further, the at least two first flow passages 10 may be independent from each other and not in communication with each other, as shown in FIG. 4. In this case, the heat transfer medium flowing through the first flow port is divided by the middle rib 111 located between two adjacent first flow passages 10 to respectively flow into the two adjacent first flow passages 10.

Figure 5:
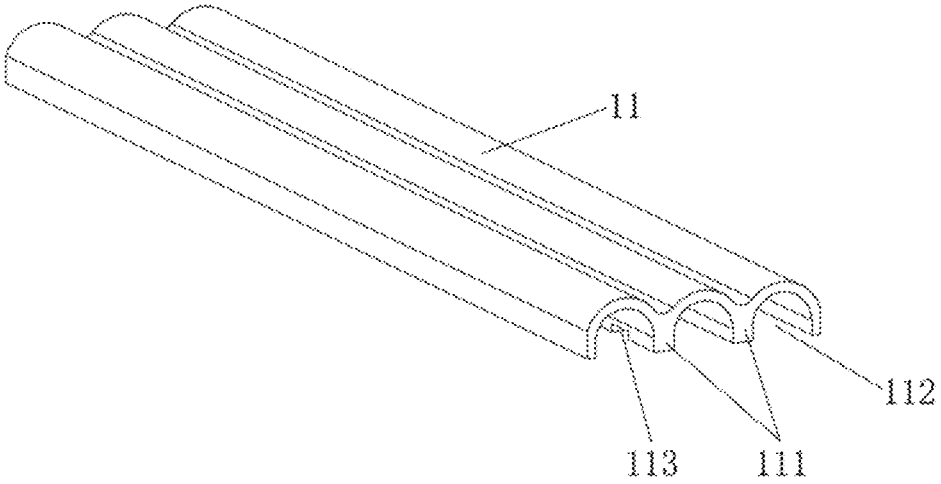
FIG. 5 is a schematic view of a first main plate with a middle rib that is formed with a hole or opening, according to the first embodiment of the present disclosure.

A hole or opening 113 (the opening 113 shown in FIG. 5) may be formed at the middle rib 111 located between two adjacent first flow passages 10, such that the two adjacent first flow passages 10 are in communication with each other. In this case, the heat transfer medium flowing through the first flow port is divided by the middle rib 111 located between the two adjacent first flow passages 10 to respectively flow into the two adjacent first flow passages 10, and then the heat transfer medium in a respective one of the first flow passages 10 flows into at least one adjacent first flow passage 10 through the hole or opening 113 formed at the middle rib 111.

Figure 6:
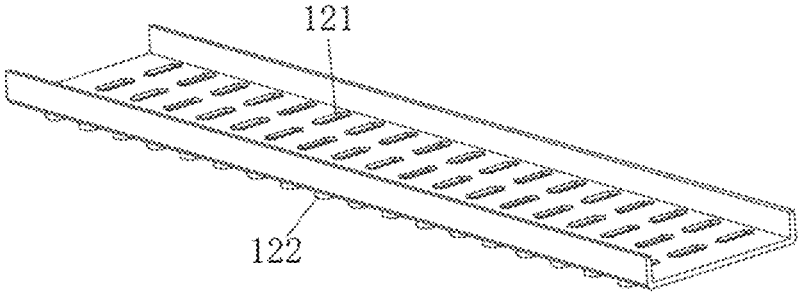
FIG. 6 is a schematic structural view of a second main plate according to the first embodiment of the present disclosure.

Referring to FIG. 6, the second main plate 12 may be a U-shaped structure, and the first main plate 11 is disposed inside the U-shaped structure of the second main plate 12, thereby forming a structure in which the second main plate 12 encloses the first main plate 11. The second main plate 12 and the first main plate 11 are then fixed and connected by brazing. It should be understood that the second main plate 12 may also be a plate-shaped structure. In this case, the first main plate 11 is directly supported on the second main plate 12 and fixed to the second main plate 12 by brazing.

As shown in FIG. 6, the second main plate 12 is provided with a plurality of rows of first heat exchange tube apertures 121, through which the heat exchange tubes 3 penetrate. The heat exchange tubes 3 are brazed at the first heat exchange tube apertures 121, such that the heat exchange tubes 3 are fixed to the second main plate 12 and sealed at joints. In this embodiment, the number of rows of the first heat exchange tube apertures 121 is the same as that of the heat exchange tubes 3, and each of the heat exchange tubes 3 passes through a respective one of the first heat exchange tube apertures 121. The first heat exchange tube apertures 121 are configured to allow the heat transfer medium in the heat exchange tubes 3 to flow into the first flow passages 10 or allow the heat transfer medium in the first flow passages 10 to flow into the heat exchange tubes 3, and to allow the heat transfer medium in the heat exchange tubes 3 to flow into the second flow passage 20 or allow the heat transfer medium in the second flow passage 20 to flow into the heat exchange tubes 3. In this embodiment, a flange 122 is disposed at a periphery of each of the first heat exchange tube apertures 121 and extends in a direction away from the first main plate 11. The flange 122 is capable of increasing a contact area with the respective heat exchange tube 3, such that a relatively large brazing surface is formed between the heat exchange tubes 3 and the second main plate 12 with a stronger brazing strength. In other embodiments, the flange may also extend toward the first main plate 11.

Alternatively, each of the first heat exchange tube apertures 121 may be an elongated, circular, or rectangular aperture, which depends on a shape of the assembled heat exchange tube 3. In this embodiment, the first heat exchange tube aperture 121 is an elongated aperture, and the heat exchange tube 3 is correspondingly a flat pipe. Further, a height of the flange 122 is associated with a thickness of the heat exchange tube 3 and is 0.7-1.3 times the thickness thereof.

In this embodiment, the heat exchanger is provided with the plurality of rows of heat exchange tubes 3. Further, each of the first flow passages 10 and each of the second flow passages 20 are provided with one row of heat exchange tubes 3, respectively. The number of rows of heat exchange tubes 3 is same as a total number of the through grooves 112 for forming the first flow passages 10 and the second flow passages 20. Alternatively, the heat exchanger may be provided with two first flow passages 10 and one second flow passage 20, and thus three rows of heat exchange tubes 3 are provided.

It should be understood that, in this embodiment, each of the first flow passages 10 and each of the second flow passages 20 are provided with one row of heat exchange tubes 3, respectively. However, one row of heat exchange tubes 3 may be provided for a plurality of first flow passages 10, or a plurality of rows of heat exchange tubes 3 may be provided for one first flow passage 10. Alternatively, one row of heat exchange tubes 3 may be provided for a plurality of second flow passages 20, or a plurality of rows of heat exchange tubes 3 may be provided for one second flow passage 20. The present disclosure is not limited to the above embodiments as long as the flow of the heat transfer medium is not affected.

In this embodiment, a density of the heat transfer medium flowing in the first flow passages 10 is less than that of the heat transfer medium flowing in the second flow passages 20. As for the same amount of the heat transfer medium, the volume of the heat transfer medium in the first flow passage 10 is greater than that of the heat transfer medium in the second flow passages 20. Further, a total volume of the first flow passages 10 is greater than that of the second flow passages 20, and the number of the heat exchange tubes 3 communicating with the first flow passages 10 is greater than that of the heat exchange tubes 3 communicating with the second flow passages 20. With this configuration, the heat transfer medium for heat exchange can flow at the relatively high flow rate in the heat exchanger.

As shown in FIG. 1, the heat exchanger further includes an end cap 8, onto which the first flow port 6 and the second flow port 7 are disposed.

It should be understood that the heat exchanger may be provided with one first flow port 6. In this case, the first flow port 6 communicates with all the first flow passages 10. Alternatively, the heat exchanger may be provided with a plurality of first flow ports 6. In this case, each of the first flow ports 6 communicates with a respective one of the first flow passages 10.

In this embodiment, the second header 2 communicates with an end of each of the heat exchange tubes 3 that is not in communication with the first flow passage 10 and the second flow passage 20. That is, both ends of the heat exchange tube 3 are connected to the first header 1 and the second header 2, respectively.

Figure 7:
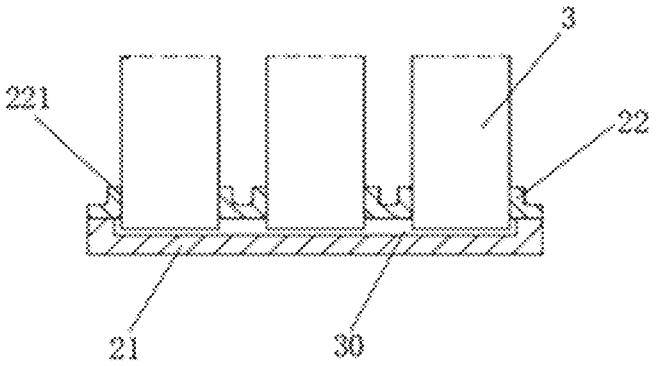
FIG. 7 is a sectional view of a second header according to the first embodiment of the present disclosure.

As shown in FIGS. 2 and 7, the second header 2 in this embodiment includes a third main plate 21 and a fourth main plate 22 that are brazed to one piece. The third main plate 21 is located below the fourth main plate 22. Each of the third main plate 21 and the fourth main plate 22 is a flat plate structure. Referring to FIG. 7, the third main plate 21 has a flat top surface, and the fourth main plate 22 has a flat bottom surface. Since each of the third main plate 21 and the fourth main plate 22 has the flat plate structure, the second header 2 in this embodiment has a more compact structure.

The third main plate 21 is formed with a recess 211 that is cooperated with the fourth main plate 22 to form a third flow passage 30. Specifically, the recess 211 is configured to accommodate all the heat exchange tubes 3. In this embodiment, the recess 211 has a width greater than a maximum distance between two outermost rows of heat exchange tubes 3, and a depth that is within a range of ⅓ to ½ of a thickness of the third main plate 21.

In this embodiment, the fourth main plate 22 is formed with a plurality of rows of second heat exchange tube apertures 221, each of which corresponds to one heat exchange tube 3. Further, one end of each of the plurality of rows of heat exchange tubes 3 passes through the respective second heat exchange tube aperture 221 and is in communication with the third flow passage 30. Each of the second heat exchange tube apertures 221 has an outer flange that protrudes in a direction away from the third main plate 21.

The outer flange is capable of increasing a contact area of the second heat exchange tube aperture 221 with the heat exchange tube 3, thereby increasing the connection strength between the second heat exchange tube aperture 221 and the heat exchange tube 3. In this embodiment, the second heat exchange tube aperture 221 is connected with the heat exchange tube 3 by brazing. In this embodiment, the second heat exchange tube aperture 221 has a length greater than a width of a necking portion of the heat exchange tube 3, and a width greater than a thickness of the heat exchange tube 3. The flange of each second heat exchange tube aperture 221 has a height that is 0.7-1.3 times the thickness of the respective heat exchange tube 3. In other embodiments, the flange of each second heat exchange tube aperture 221 may also extend toward the third main plate 21.

It should be understood that in the second header 2 according to this embodiment, the recess 211 may be directly formed in the fourth main plate 22, the third main plate 21 may only have a flat plate structure, and the third flow passage 30 is formed between the recess 211 and the third main plate 21.

The following description illustrates an operation principle of the heat exchanger as described in this embodiment, which is used as a condenser.

Firstly, a gaseous heat transfer medium enters through the first flow port 6, and then flows to the first flow passage 10 of the first header 1, which has a relatively large total volume. At this time, the heat transfer medium flows into the heat exchange tubes 3 communicating with the first flow passage 10 and exchanges heat with other mediums. The heat transfer medium finally flows into the third flow passage 30 of the second header 2 through the heat exchange tubes 3 communicating with the first flow passage 10, and flows into the heat exchange tubes 3 communicating with the second flow passage 20 through the third flow passage 30. The heat transfer medium then flows into the second flow passage 20 through the heat exchange tubes 3 communicating with the second flow passage 20, and further exchanges heat with other mediums such as air during this process. Finally, the heat transfer medium flows out of the second flow port 7 and the heat exchange is completed, and at this moment, the heat transfer medium is in the liquid state or the gas-liquid mixed state.

The following description illustrates an operation principle of the heat exchanger as described in this embodiment, which is used as an evaporator.

Firstly, a heat transfer medium in a liquid or gas-liquid mixed state flows into the second flow passage 20 of the first header 1, which has a relatively small total volume, through the second flow port 7. At this moment, the heat transfer medium flows into the heat exchange tubes 3 communicating with the second flow passage 20 and exchanges heat with other mediums. The heat transfer medium flows into the second header 2 through the heat exchange tubes 3 in communication with the second flow passage 20, and flows into the heat exchange tubes 3 in communication with the first flow passage 10 through the third flow passage 30. Thereafter, the heat transfer medium flows into the first flow passages 10 through the heat exchange tubes 3 in communication with the first flow passages 10, and further exchanges heat with other mediums, such as air. The heat transfer medium finally flows out of the first flow port 6, and the heat exchange is completed. At this time, the heat transfer medium is in the gaseous state.

In the heat exchanger according to this embodiment as described above, the heat transfer medium flows in the gaseous state in the first flow passages 10, and flows in the liquid or gas-liquid mixed state in the second flow passages 20. The total volume of the first flow passages 10 is greater than that of the second flow passages 20, and the total volume of the flow channels of the heat exchange tubes 3 in communication with the first flow passages 10 is greater than that of the flow channels of the heat exchange tubes 3 in communication with the second flow passages 20. Accordingly, when a predetermined amount of the heat transfer medium flows in the heat exchanger, the gaseous heat transfer medium is capable of flowing in the flow passages with the larger total volume, and when the heat transfer medium in the liquid or gas-liquid mixed state can flow in the flow passages with the smaller total volume. Therefore, the heat transfer medium required for heat exchange is capable of flowing at the relatively high flow rate, thereby improving the heat exchange performance. Moreover, the heat exchanger has higher structural strength and is applicable to high-pressure heat transfer mediums.

Second Embodiment

Figure 8:
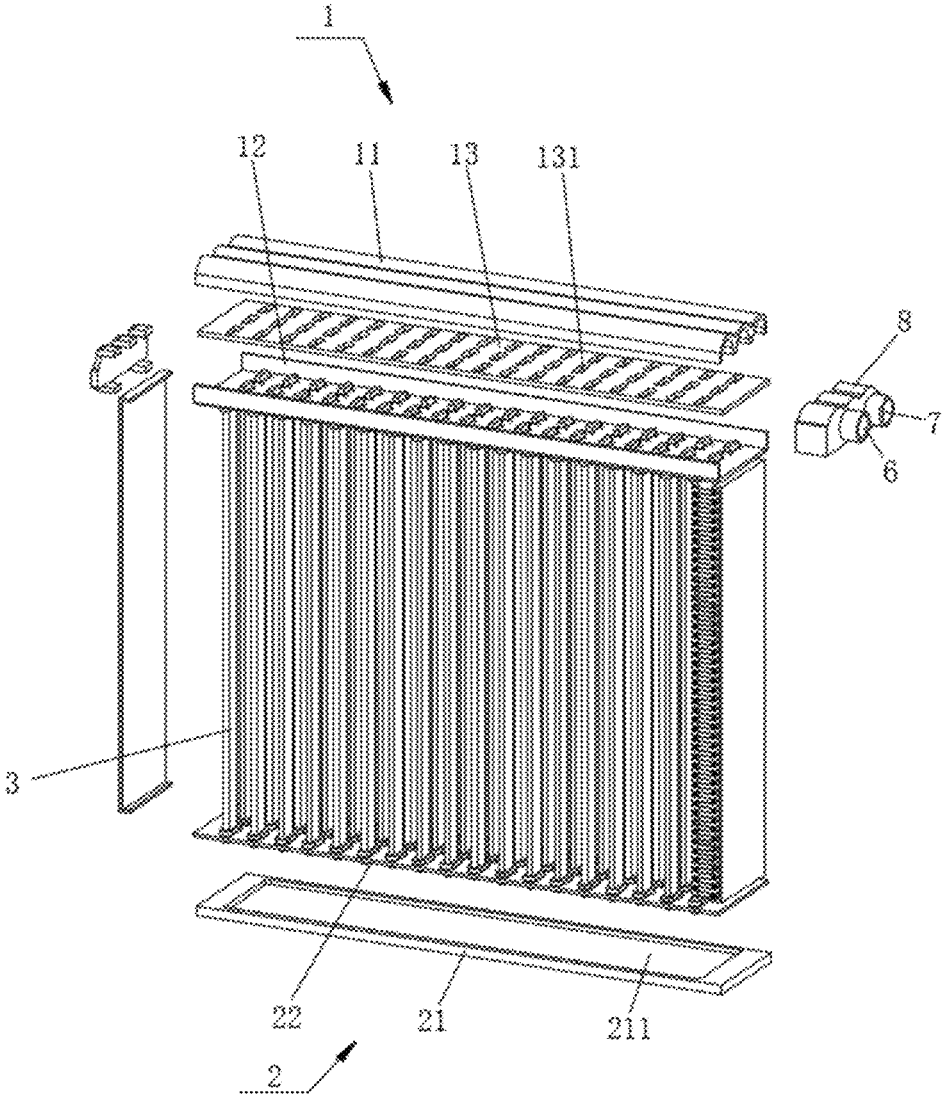
FIG. 8 is an exploded view of a heat exchanger according to a second embodiment of the present disclosure.
Figure 9:
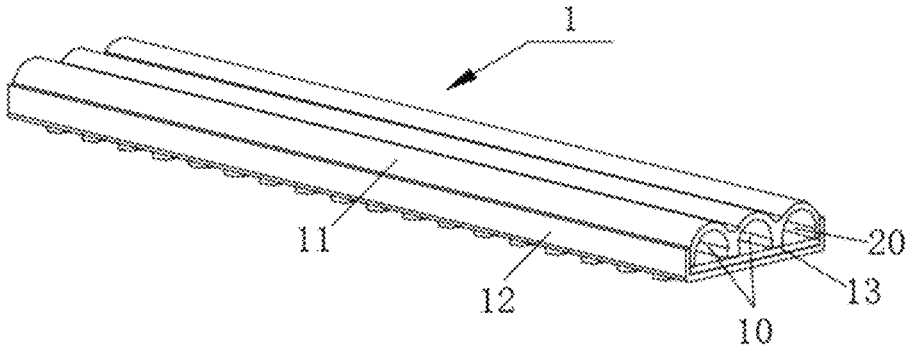
FIG. 9 is a schematic structural view of a first header according to the second embodiment of the present disclosure.

The difference between the second embodiment and the first embodiment is the structure of the first header 1. Specifically, as shown in FIGS. 8 and 9, a first header 1 according to the second embodiment includes a first main plate 11, a second main plate 12 and a first middle plate 13. The first main plate 11 and the second main plate 12 in this embodiment are the same as those described in the first embodiment in structure. The difference between the second embodiment and the first embodiment is in that in the second embodiment, middle ribs 111 of the first main plate 11 in this embodiment are supported on the first middle plate 13, the second main plate 12 encloses the first middle plate 13 and the first main plate 11, and the second main plate 12, the first middle plate 13 and the first main plate 11 are fixed and connected with each other by brazing to form a first flow passage 10 and a second flow passage 20.

Specifically, the first middle plate 13 in the second embodiment is formed with a plurality of rows of first elongated apertures 131, and the number of rows of the first elongated apertures 131 is the same as a sum of numbers of the first flow passage 10 and the second flow passage 20. Further, the first elongated apertures 131 are in a one-to-one correspondence with the first heat exchange tube apertures 121. That is, each row of first elongated apertures 131 corresponds to one first flow passage 10 or one second flow passage 20. The first flow passage 10 and the second flow passage 20 are formed among the through grooves 112 of the first main plate 11, the first elongated apertures 131, and the second main plate 12. The first middle plate 13 is disposed between the first main plate 11 and the second main plate 12, and the first main plate 11, the first middle plate 13 and the second main plate 12 are fixed and connected with each other by brazing. Thus, the strength of the overall structure of the first header 1 is increased.

The first heat exchange tube apertures 121 of the second main plate 12 are in one-to-one correspondence with the first elongated apertures 131, and one end of the heat exchange tube 3 hermetically passes through the first heat exchange tube aperture 121 and is received in the first elongated aperture 131.

Other structures of the heat exchanger according to the second embodiment are the same as those in the first embodiment, and the operation principle thereof is also the same as that described in the first embodiment, and thus the detailed description thereof will be omitted herein.

Third Embodiment

Figure 10:
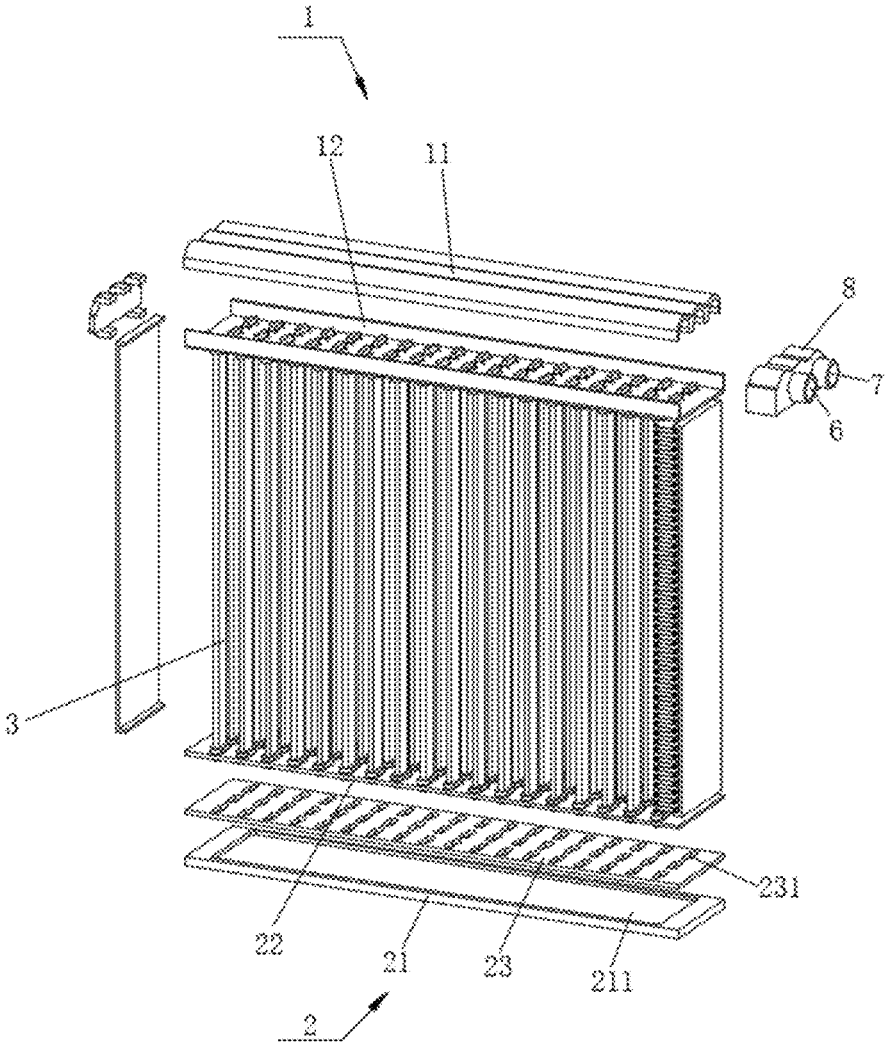
FIG. 10 is an exploded view of a heat exchanger according to a third embodiment of the present disclosure.
Figure 11:
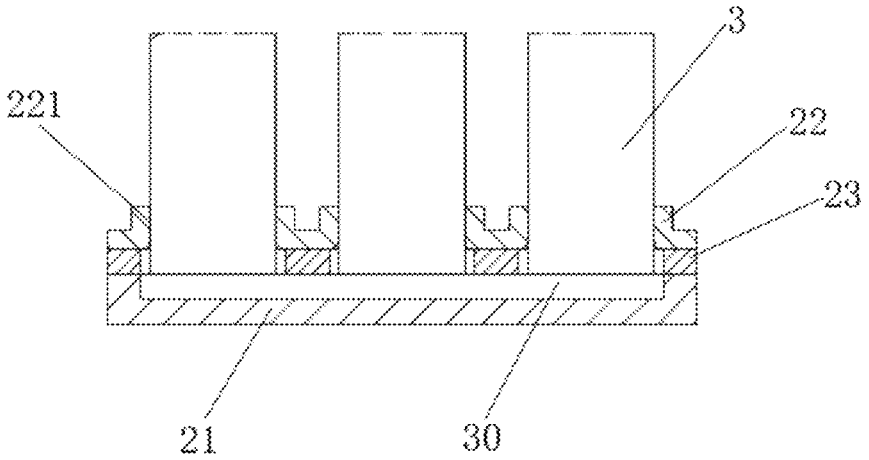
FIG. 11 is a sectional view of a second header according to the third embodiment of the present disclosure.

The difference between the third embodiment and the first embodiment is the structure of the second header 2. Specifically, as shown in FIGS. 10 and 11, the second header 2 according to the third embodiment includes a third main plate 21, a fourth main plate 22 and a second middle plate 23. The third main plate 21 and the fourth main plate 22 are the same as those described in the first embodiment in structure. The difference between the third embodiment and the first embodiment is in that in the third embodiment, the fourth main plate 22, the second middle plate 23 and the third main plate 21 are fixed and connected with each other by brazing to form a third flow passage 30.

Specifically, the second middle plate 23 according to the third embodiment is formed with a plurality of rows of second elongated apertures 231, and a number of rows of the second elongated apertures 231 is the same as that of rows of the heat exchange tubes 3. The second elongated apertures 231 are in one-to-one correspondence with the second heat exchange tube apertures 221. That is, one of the second elongated apertures 231 corresponds to one of the heat exchange tubes 3. The third flow passage 30 is formed among the recess 211 of the third main plate 21, the second elongated apertures 231, and the fourth main plate 22. In this embodiment, the second middle plate 23 is disposed between the third main plate 21 and the fourth main plate 22, and the third main plate 21, the second middle plate 23 and the fourth main plate 22 are fixed and connected with each other by brazing. Thus, the strength of the overall structure of the second header 2 is increased.

The second heat exchange tube apertures 221 of the fourth main plate 22 are in one-to-one correspondence with the second elongated apertures 231, and one end of the heat exchange tube 3, which is not in communication with the first header 1, hermetically passes through the second heat exchange tube aperture 221 and is received in the second elongated aperture 231. Other structures of the heat exchanger according to the third embodiment are the same as those in the first embodiment, and the operation principle thereof is also the same as that described in the first embodiment, and thus the detailed description thereof will be omitted herein.

Fourth Embodiment

Figure 12:
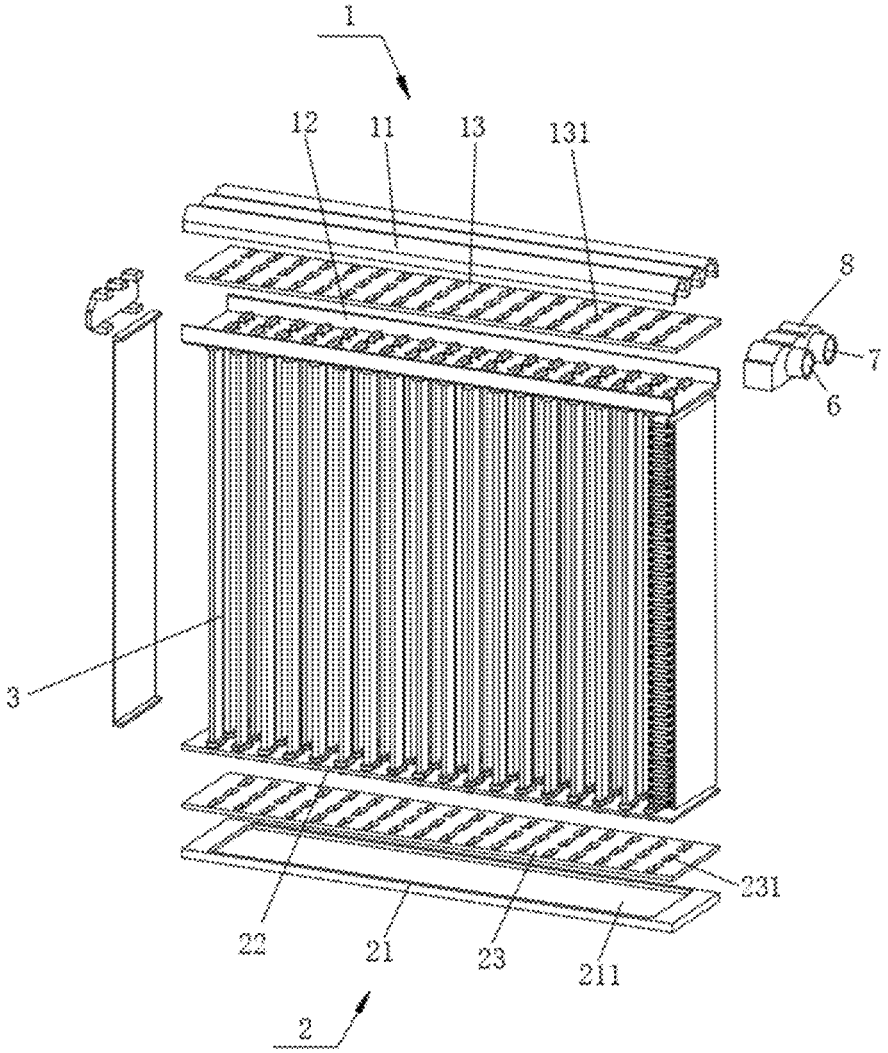
FIG. 12 is an exploded view of a heat exchanger according to a fourth embodiment of the present disclosure.

The difference between the fourth embodiment and the second embodiment is the structure of the second header 2. Specifically, as shown in FIG. 12, the structure of the second header 2 in this embodiment are the same as that described in the third embodiment. That is, the second header 2 in this embodiment includes a second middle plate 23. In addition, other structures of the heat exchanger according to the fourth embodiment are the same as those in the second embodiment, and the operation principle thereof is also the same as that described in the second embodiment, and thus the detailed description thereof will be omitted herein.

Fifth Embodiment

Figure 13:
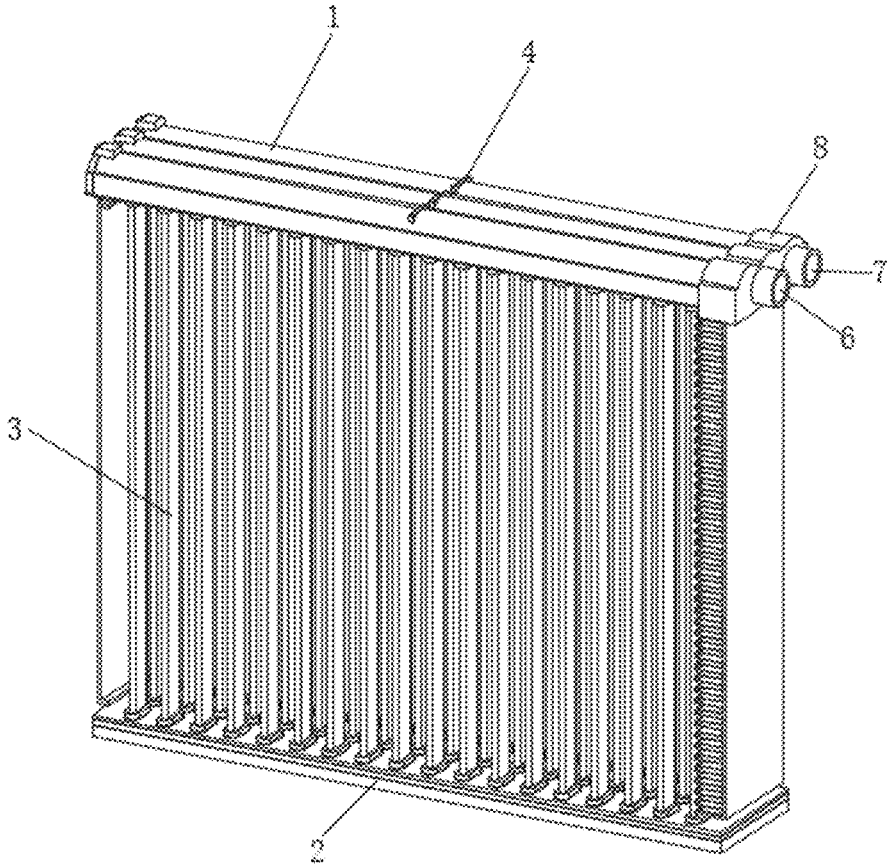
FIG. 13 is a schematic structural perspective view of a heat exchanger according to a fifth embodiment of the present disclosure.
Figure 14:
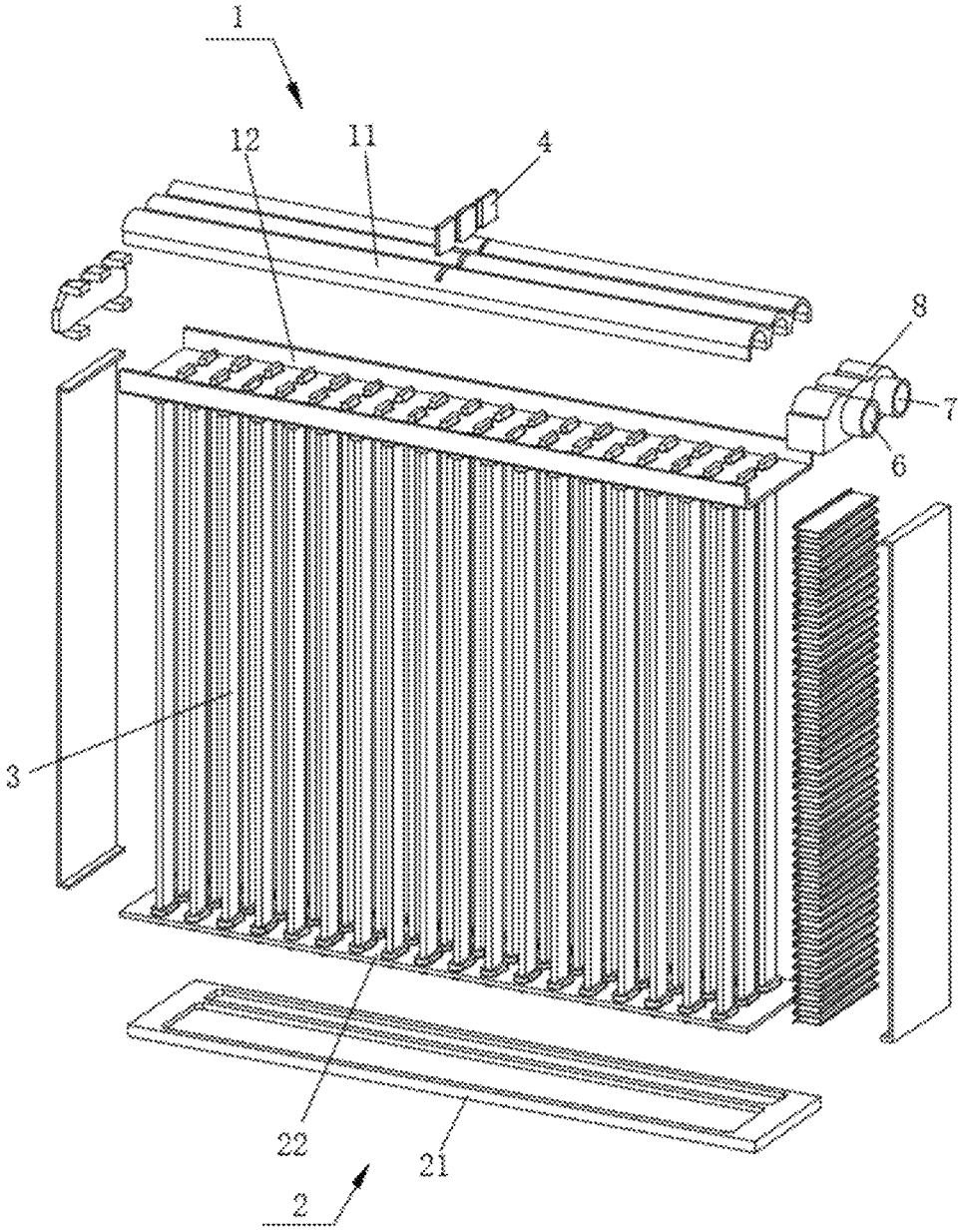
FIG. 14 is an exploded view of the heat exchanger according to the fifth embodiment of the present disclosure.

In the fifth embodiment, the first header 1 of the first embodiment is additionally provided with a first partition plate 4 to realize a four-flow-path heat exchange. Specifically, as shown in FIGS. 13 and 14, in this embodiment, each of the first flow passage 10 and the second flow passage 20 of the first header 1 includes a first end and a second end. The first end of the first flow passage 10 and the first end of the second flow passage 20 are located at the same side (the left side in FIG. 13), and the second end of the first flow passage 10 and the second end of the second flow passage 20 are located at the same side (the right side in FIG. 13). Furthermore, the first end of the first flow passage 10 communicates with the first end of the second flow passage 20. For example, this communication may be achieved by a hole or opening formed in the middle rib 111 between the first flow passage 10 and the second flow passage 20. In addition, the first flow port 6 communicates with the second end of the first flow passage 10, and the second flow port 7 communicates with the second end of the second flow passage 20.

The first partition plate 4 is disposed between the first end and the second end of the first flow passage 10, and between the first end and the second end of the second flow passage 20. The first partition plate 4 between the first end and the second end of the first flow passage 10 is configured to partition the first flow passage 10, and the first partition plate 4 between the first end and the second end of the second flow passage 20 is configured to partition the second flow passage 20. The first main plate 11 is formed with a set of partition plate apertures (not shown in the figures) in a width direction thereof, and each of the first partition plates 4 is inserted into a respective one of the partition plate apertures. The first partition plate 4 is provided such that each of the first flow passage 10 and the second flow passage 20 is partitioned into a first section and a second section, which can realize a multi-flow-path flow of the heat transfer medium. It should be noted that the first sections close to the first flow port 6 and the second flow port 7 are not in communication with each other, and the second sections away from the first flow port 6 and the second flow port 7 are in communication with each other, thereby achieving the four-flow-path heat exchange.

The third flow passage 30 includes two flow channels independent from each other. One of the flow channels communicates with the heat exchange tubes 3 in communication with all the first flow passages 10, and the other of the flow channels communicates with the heat exchange tubes 3 in communication with the second flow passage 20. That is, in this embodiment, referring to FIG. 14, the third main plate 21 of the second header 2 is formed with two recesses 211, and each of the two flow channels is formed between the second main plate 12 and a respective one of the recesses 211. In this embodiment, each of the two flow channels has a first end and a second end. Further, the first ends of the two flow channels are located at the same side, and the second ends of the two flow channels are located at the other side. Furthermore, the first ends of the flow channels, the first ends of the first flow passages 10 and the first end of the second flow passage 20 are all located at the same side of the heat exchanger, and the second ends of the flow channels, the second ends of the first flow passages 10 and the second end of the second flow passage 20 are all located at the other side of the heat exchanger.

The following description illustrates an operation principle of the heat exchanger as described in this embodiment, which is used as a condenser.

Firstly, a heat transfer medium flows into the second sections of the first flow passages 10, which are located between the first partition plates 4 and the first flow port 6, through the first flow port 6. At this time, the heat transfer medium is flowing in a first flow path. Then, the heat transfer medium flows into the heat exchange tubes 3 in communication with the second sections of the first flow passages 10 and flows along the heat exchange tubes 3, and exchanges heat with other medium such as air. Thereafter, the heat transfer medium flows into the second section of the flow channel of the flow passage 30 along the heat exchange tubes 3, in which this second section corresponds to the heat exchange tubes 3, and then the heat transfer medium flows into the first section of this flow channel. Then, the heat transfer medium flows into the heat exchange tubes 3 in communication with this first section. At this time, the heat transfer medium is flowing in a second flow path, in which the heat transfer medium further exchanges heat with other mediums, and finally flows into the first sections of the first flow passages 10.

Thereafter, the heat transfer medium flows into the first section of the second flow passage 20 through the first sections of the first flow passages 10, and flows into the heat exchange tubes 3 in communication with the first section of the second flow passage 20. The heat transfer medium further exchanges heat with other mediums during the flowing. At this time, the heat transfer medium is flowing in a third flow path. Then, the heat transfer medium flows into the first section of the other flow channel corresponding to the second flow passage 20 and flows into the second section of the other flow channel, and then flows into the heat exchange tubes 3 in communication with the second section of the second flow passage 20 through the second section of the other flow channel. At this time, the heat transfer medium is flowing in a fourth flow path, in which the heat transfer medium exchanges heat with other medium, and finally flows into the second section of the second flow passage 20. Thereafter, the heat transfer medium flows out of the second flow port 7 in communication with the second section of the second flow passage 20, and the heat exchange process is completed.

The heat exchanger according to this embodiment is provided with the first partition plates 4, achieving the four-flow-path heat exchange, which further improves the heat exchange effect.

Sixth Embodiment

Figure 15:
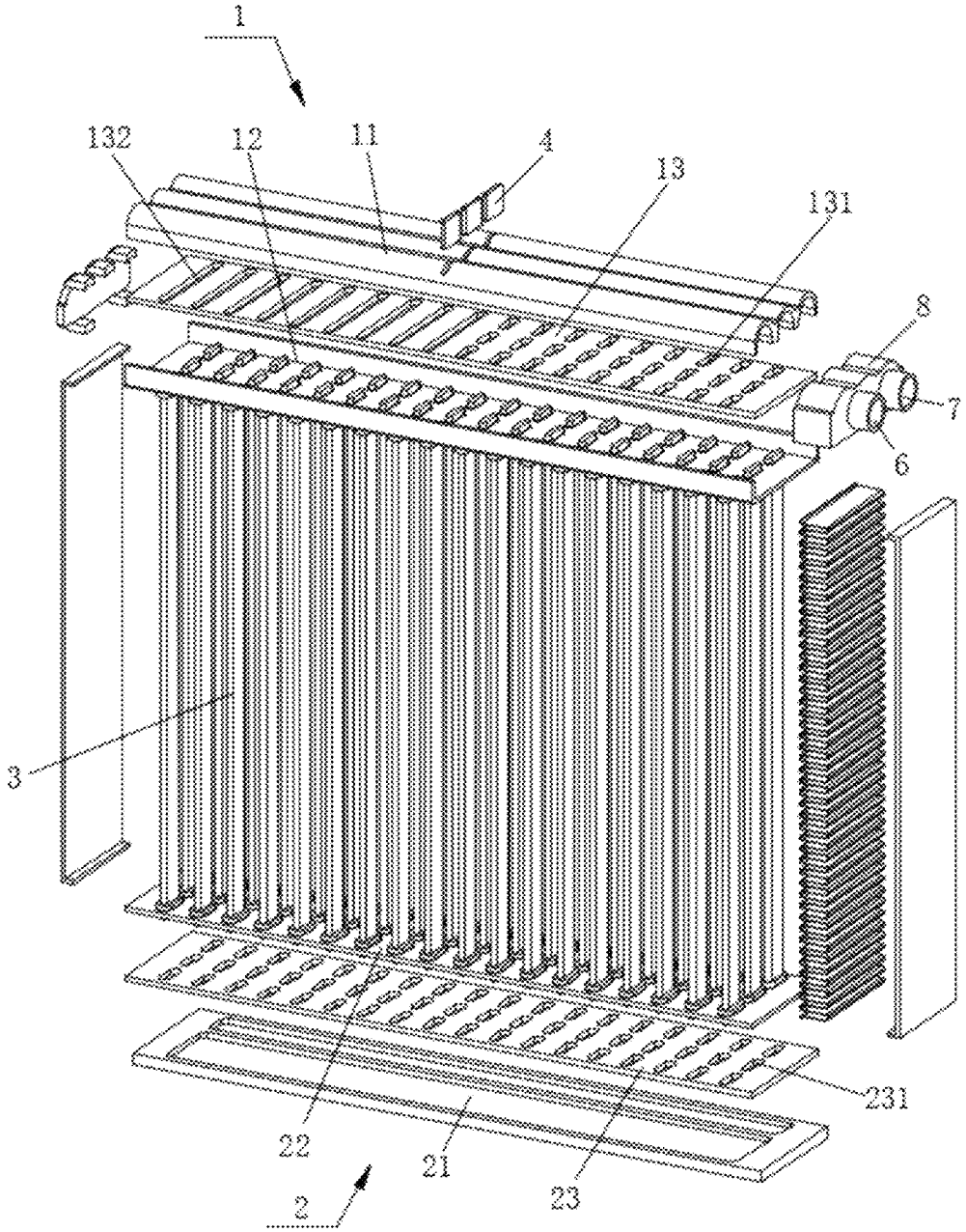
FIG. 15 is an exploded view of a heat exchanger according to a sixth embodiment of the present disclosure.

The difference between the sixth embodiment and the fifth embodiment is in that the first header 1 in the sixth embodiment includes a first middle plate 13, as shown in FIG. 15. In this case, the first middle plate 13 is formed with first elongated apertures 131 at a side of each of the first partition plates 4 and third elongated apertures 132 at the other side of each of the first partition plates 4. The first elongated apertures 131 are located at the side of the first partition plate 4 close to the first flow port 6. The third elongated apertures 132 are disposed away from the first flow port 6. The third elongated apertures 132 are configured to communicate the first flow passages 10 and the second flow passage 20 to allow the heat transfer medium to flow from the first flow passages 10 into the second flow passage 20.

However, it should be understood that the second header 2 in this embodiment may further include a second middle plate 23, the structure and mounting position of the second middle plate 23 are the same as those of the second middle plate 23 described in the third embodiment, and the detailed description thereof will be omitted herein.

Other structures of the heat exchanger according to the sixth embodiment are the same as those in the fifth embodiment, and the operation principle of the heat exchanger in this embodiment is also the same as that described in the fifth embodiment, and thus the detailed description thereof will be omitted herein.

Seventh Embodiment

Figure 16:
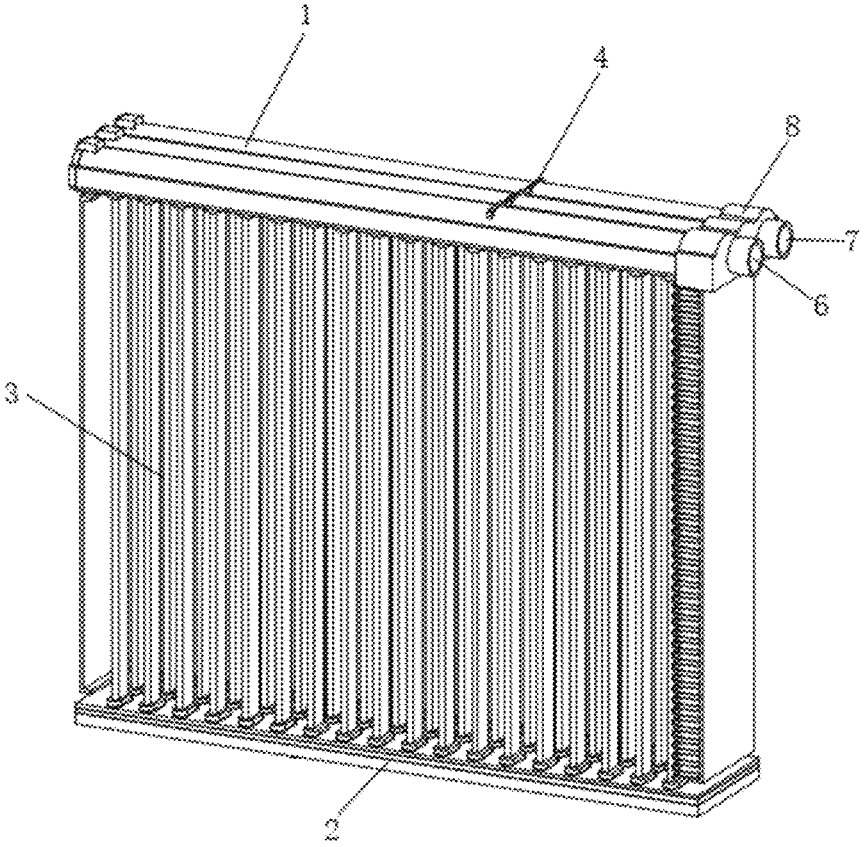
FIG. 16 is a schematic structural perspective view of a heat exchanger according to a seventh embodiment of the present disclosure.
Figure 17:
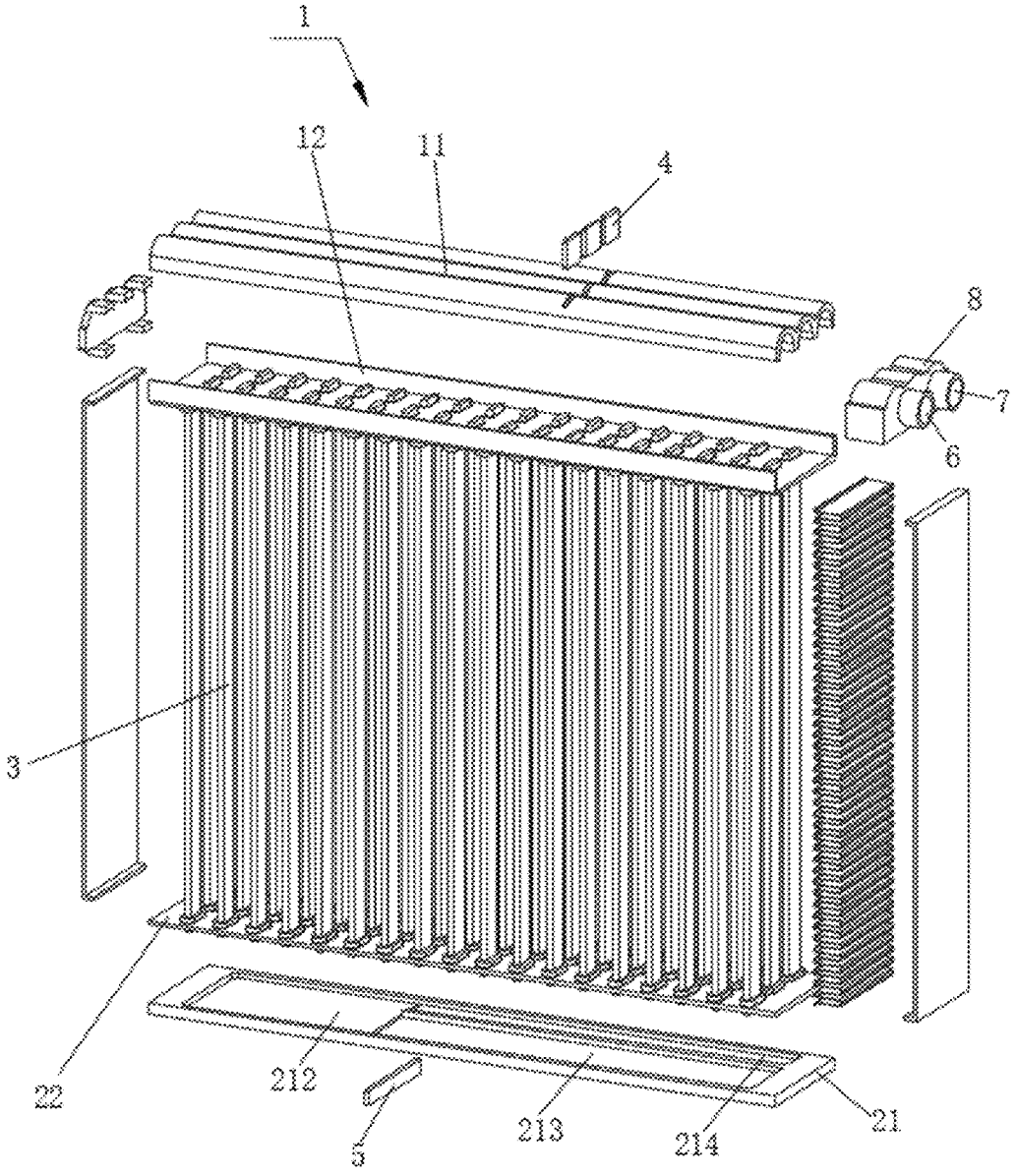
FIG. 17 is an exploded view of the heat exchanger according to the seventh embodiment of the present disclosure.

In the seventh embodiment, the two flow channels of the second header 2 in the fifth embodiment are additionally provided with a second partition plate 5, and the structure of the recess 211 is modified, to realize a six-flow-path heat exchange. Specifically, the third flow passage 30 of the second header 2 in this embodiment includes a first flow channel, a second flow channel, and a third flow channel, as shown in FIGS. 16 and 17. The first flow channel and the second flow channel are partitioned by the second partition plate 5, and the first flow channel and the third flow channel are also partitioned by the second partition plate 5, so that the three flow channels are independent from each other.

In this embodiment, as shown in FIG. 17, the recess 211 may include a first recess 212, a second recess 213 and a third recess 214. The second partition plate 5 is disposed between the first recess 212 and the second recess 213, and between the first recess 212 and the third recess 214. The first flow channel, the second flow channel and the third flow channel are formed by the second partition plate 5, the fourth main plate 22, and the three recesses.

In this embodiment, the first flow channel communicates with the heat exchange tubes 3 between the first ends of the first flow passages 10 and the second partition plate 5, and communicates with the heat exchange tubes 3 between the first end of the second flow passage 20 and the second partition plate 5, respectively.

The second flow channel communicates with the heat exchange tubes 3 between the second ends of the first flow passages 10 and the second partition plate 5, and the third flow channel communicates with the heat exchange tubes 3 between the second end of the second flow passage 20 and the second partition plate 5.

In this embodiment, the third main plate 21 may be formed with a partition plate aperture (not shown in the figures), into which the second partition 5 is inserted to form the three flow channels.

In this embodiment, the second partition 5 is horizontally disposed at a side of the first partition plates 4 away from the first flow port 6, such that a length of a flow passage of the first header 1 at a first side (the right side in FIG. 16) of the first partition plate 4 is greater than that of the first flow channel, wherein this flow passage of the first header 1 includes the first end of the first flow passages 10 and the first end of the second flow passage 20. With this structure, the six-flow-path heat exchange structure of the heat exchanger can be achieved.

Other structures of the heat exchanger according to the seventh embodiment are the same as those in the fifth embodiment, and thus the detailed description thereof will be omitted herein.

The following description illustrates an operation principle of the heat exchanger as described in this embodiment, which is used as a condenser.

Firstly, a heat transfer medium flows into channels between the second end of the first flow passage 10 (the right side in FIG. 17) and the first partition plates 4 through the first flow port 6, and then flows into the heat exchange tubes 3 in communication with channels between the second end of the first flow passage 10 and the first partition plates 4, and flows along these heat exchange tubes 3. At this time, the heat transfer medium exchanges heat with other mediums such as air. This is the first flow path.

The heat transfer medium flows into the second flow channel, and due to the action of the second partition plate 5, the heat transfer medium will flow into the heat exchange tubes 3 located between the first partition plates 4 and the second partition plate 5 and communicating with the first flow passages 10. The heat transfer medium further exchange heat with other mediums. This is the second flow path.

Thereafter, the heat transfer medium then flows into channels between the first ends of the first flow passages 10 (the left side in FIG. 17) and the first partition plate 4, then flows into the heat exchange tubes 3 communicating with channels between the first ends of the first flow passages 10 and the second partition plate 5, and further exchanges heat with other mediums again. This is the third flow path.

After flowing into the first flow channel, the heat transfer medium flows along the heat exchange tubes 3 communicating with a channel between the first end of the second flow passage 20 and the second partition plate 5, and exchanges heat with other mediums. In this case. This is the fourth flow path.

The heat transfer medium flows into a channel between the first end of the second flow passage 20 (the left side in FIG. 17) and the first partition plates 4, and then flows into the heat exchange tubes 3 that are located between the first partition plates 4 and the second partition plate 5 and communicate with the second flow passage 20. In this case, the heat transfer medium exchanges heat with other mediums. This is the fifth flow path.

After flowing into the third flow channel, the heat transfer medium flows into the heat exchange tubes 3 communicating with a channel between the second end of the second flow passage 20 (the right side in FIG. 17) and the first partition plate 4, and further exchanges heat with other mediums. The heat transfer medium finally flows into the channel between the second end of the second flow passage 20 (the right side in FIG. 17) and the first partition plate 4, and flows out of the second flow port 7. The heat exchange process is completed. This is the sixth flow path.

In a case where the heat exchanger in this embodiment is used as an evaporator, the heat transfer medium flows from the second flow port 7 and out of the first flow port 6. A flow direction of the heat transfer medium is opposite to that of the heat transfer medium in the case where the heat exchanger is used as the condenser, and thus the detailed description thereof will be omitted herein.

The heat exchanger according to this embodiment is capable of realizing the six-flow-path heat exchange, which further improves the heat exchange performance.

Eighth Embodiment

Figure 18:
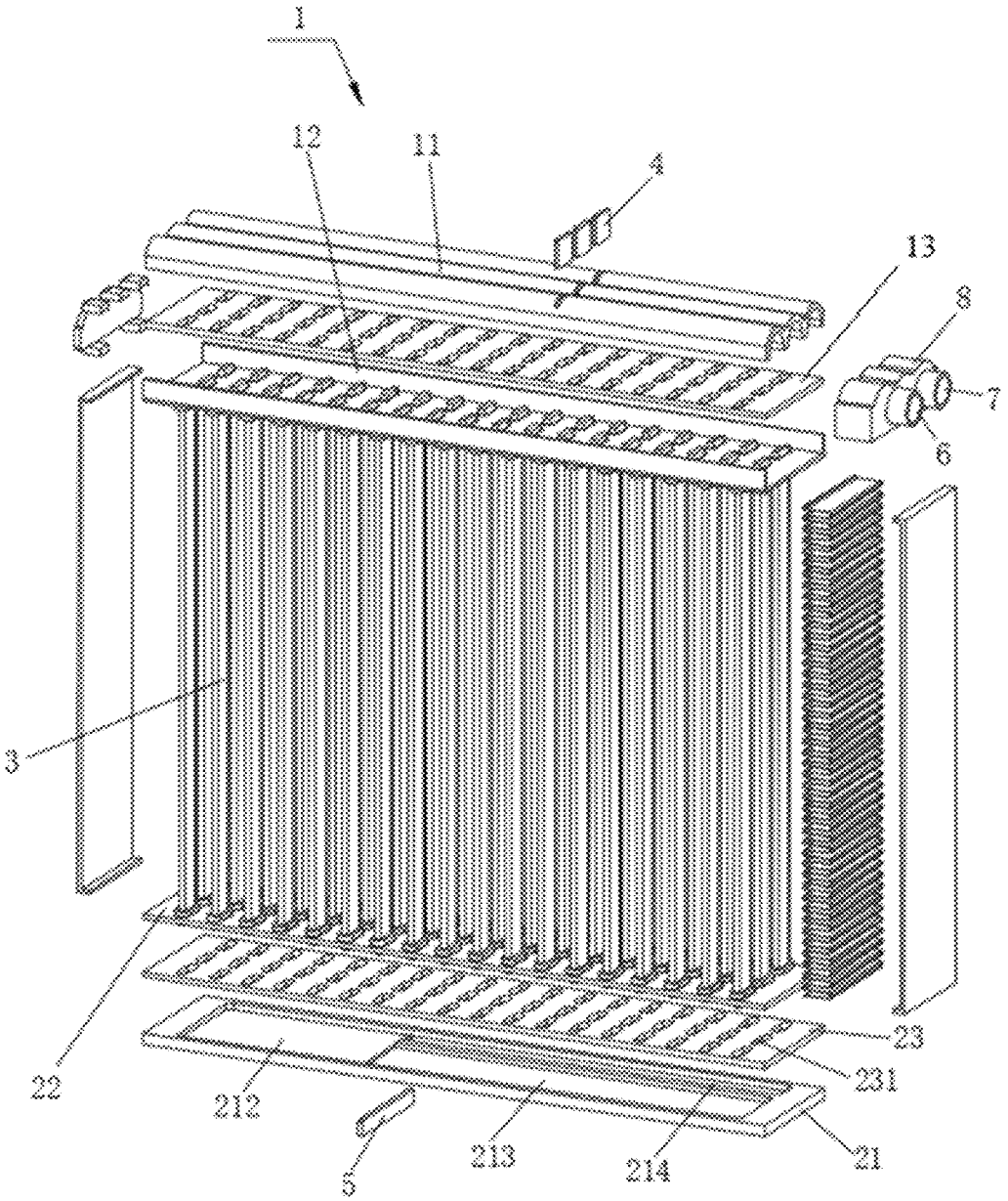
FIG. 18 is an exploded view of a heat exchanger according to an eighth embodiment of the present disclosure.

The difference between the eighth embodiment and the seventh embodiment is in that the first header 1 in this embodiment includes a first middle plate 13. As shown in FIG. 18, the structure of the first middle plate 13 in this embodiment is the same as that of the first middle plate 13 described in the second embodiment. Other structures of the heat exchanger according to the eighth embodiment are the same as those in the seventh embodiment, and the operation principle of the heat exchanger in this embodiment is also the same as that described in the fifth embodiment, and thus the detailed description thereof will be omitted herein.

However, it should be understood that the second header 2 in this embodiment may further include a second middle plate 23, and the structure and mounting position of this second middle plate 23 are the same as those of the second middle plate 23 described in the third embodiment. Accordingly, the detailed description thereof will be omitted herein.

Ninth Embodiment

Figure 19:
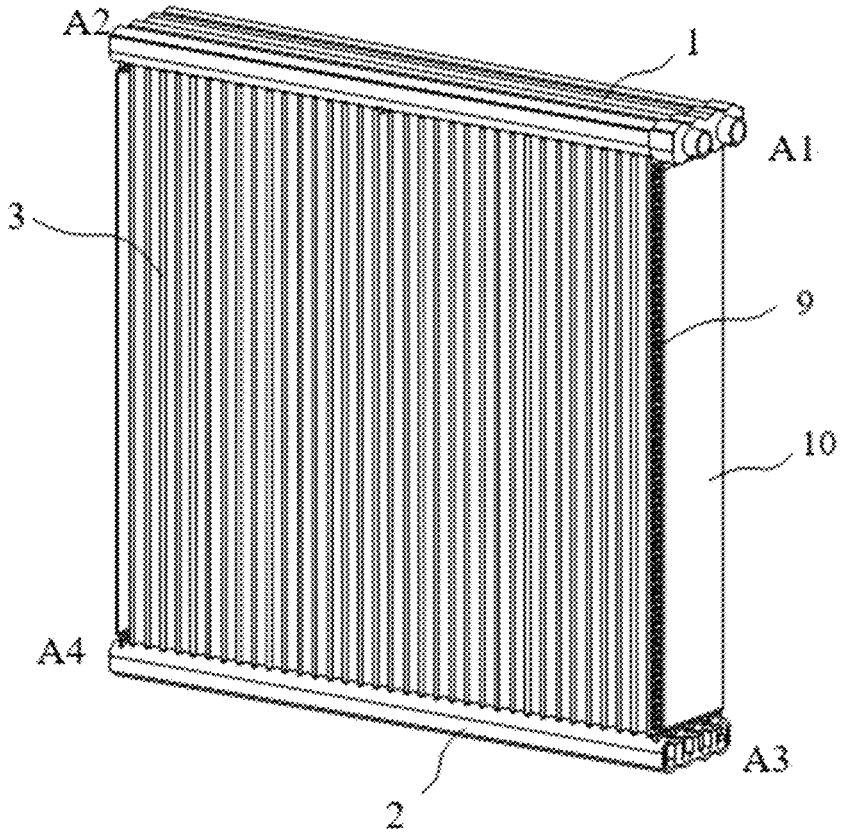
FIG. 19 is a schematic structural view of a heat exchanger according to a ninth embodiment of the present disclosure.
Figure 20:
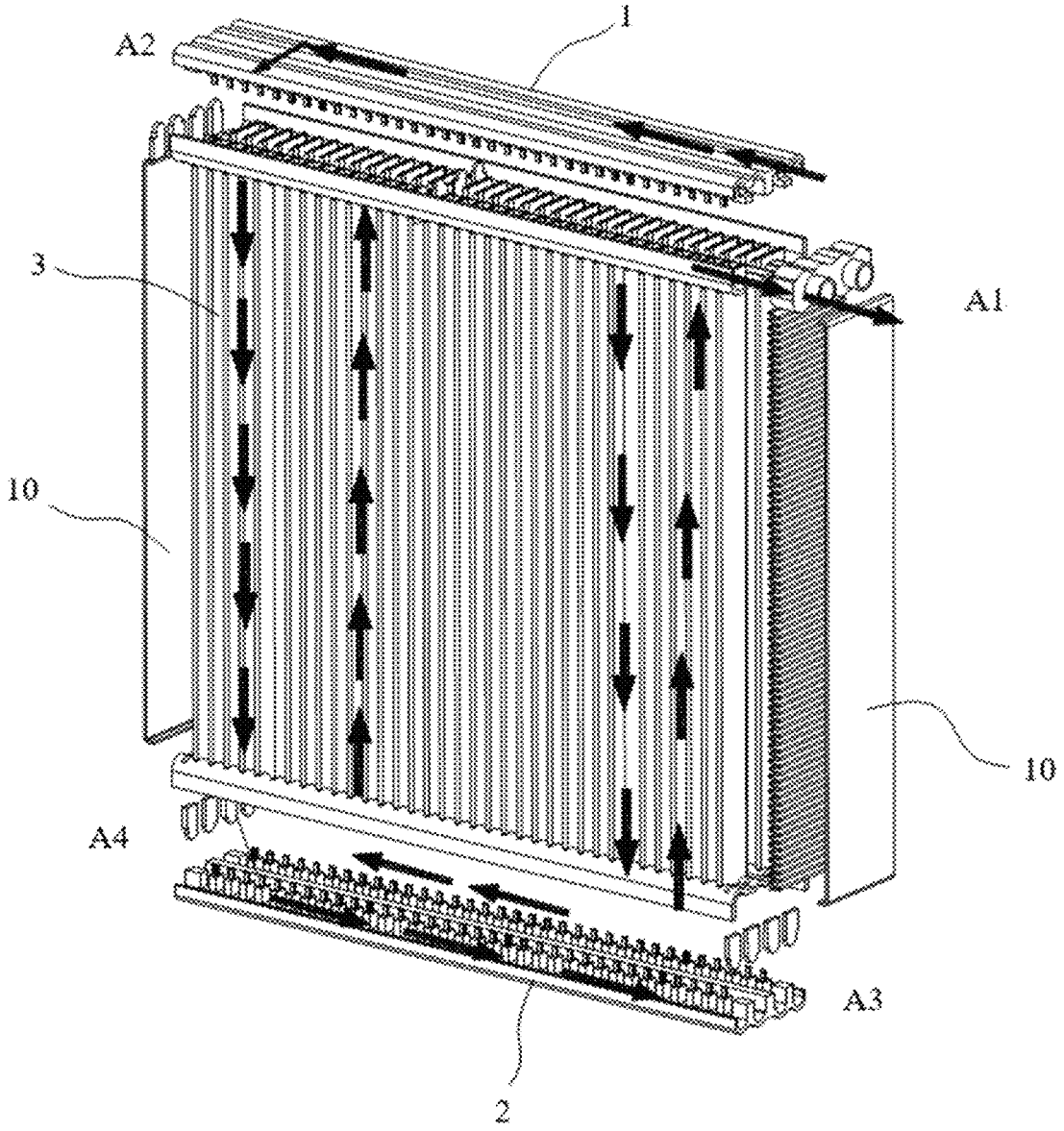
FIG. 20 is an operation flow chart of the heat exchanger according to the ninth embodiment of the present disclosure.
Figure 21:
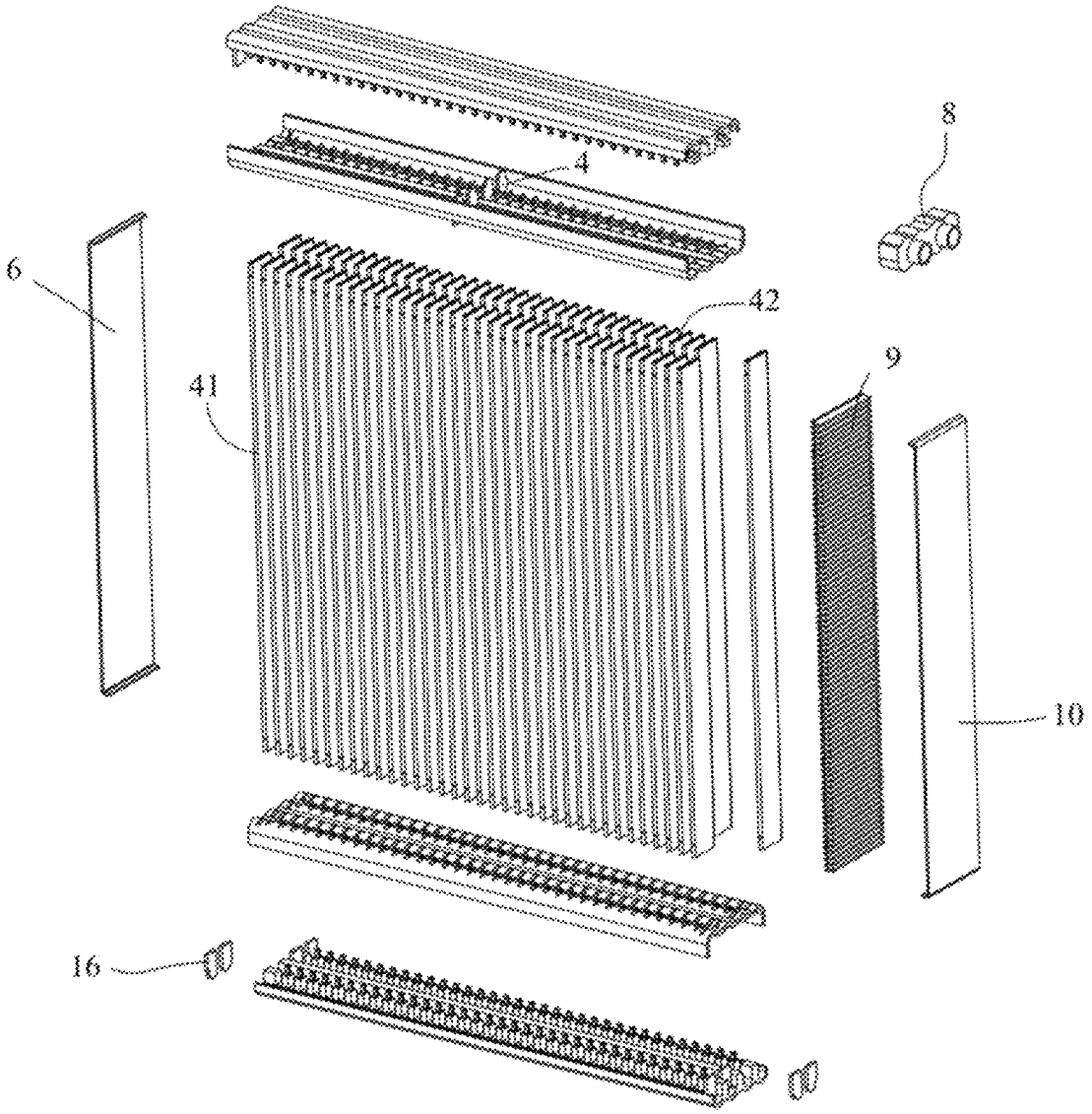
FIG. 21 is a schematic exploded view of the heat exchanger according to the ninth embodiment of the present disclosure.

FIG. 19 is a schematic structural view of a heat exchanger according to a ninth embodiment of the present disclosure, FIG. 20 is an operation flow chart of the heat exchanger according to the ninth embodiment of the present disclosure, and FIG. 21 is a schematic exploded view of the heat exchanger according to the ninth embodiment of the present disclosure. As shown in FIGS. 19 to 21, the heat exchanger according to the ninth embodiment of the present disclosure includes heat exchange tubes 3, a first header 1, and a second header 2. Alternatively, the heat exchange tubes 3 may be arranged in two rows including a front row and a rear row. Each of the heat exchange tubes 3 is connected to the first header 1 at one end thereof, and is connected to the second header 2 at the other end thereof. Each of the heat exchange tubes 3 has an inner cavity in communication with an inner cavity of the first header 1 and an inner cavity of the second header 2.

Alternatively, the heat exchanger further includes fins 9 and a cover plate 14. The fins 9 are at least partially attached to the heat exchange tubes 3. The cover plate 14 is disposed outside the outermost fin 9. The attachment between the fins 9 and the heat exchange tubes 3 is capable of improving the heat exchange efficiency of the heat exchanger. The cover plate 14 is capable of protecting the fins 9 and the heat exchange tubes 3.

It should be understood that the cover plate 14 may be an aluminum plate or the heat exchange tube 3. In a case where the cover plate 14 is the heat exchange tube, this heat exchange tube, however, does not perform the heat exchange and only functions to protect the fins 9 and the heat exchange tubes 3.

Figure 22:
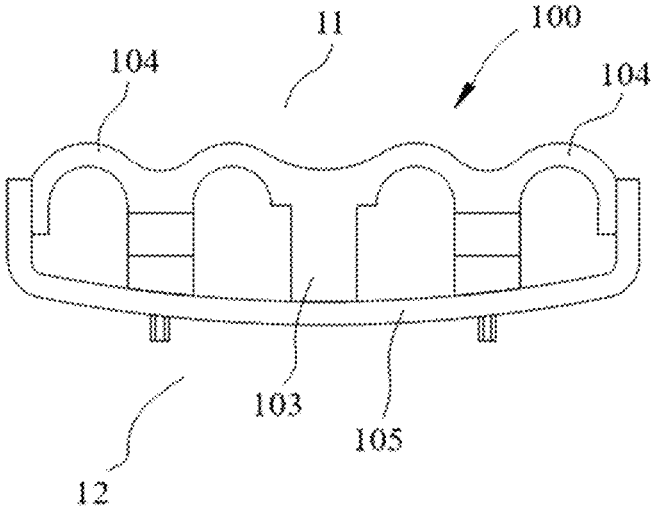
FIG. 22 is a schematic structural view of a first type of header according to the ninth embodiment of the disclosure.

FIG. 22 is a schematic structural view of a first type of header according to the ninth embodiment of the present disclosure. As shown in FIG. 22, a header 100 is also provided in this embodiment. The header 100 described in this embodiment may be used as at least one of the first header 1 or the second header 2 as described above.

The header 100 includes a first main plate 11 and a second main plate 12 that are hermetically connected with each other.

In this embodiment, the first main plate 11 and the second main plate 12 may be fixed and connected by brazing to form the header 100 of substantially "8" shape. However, the first main plate 11 and the second main plate 12 may also be connected by riveting, adhesive or other processes.

The first main plate 11 includes a first rib 103 and at least two first curved sections 104. The first rib 103 is connected to two adjacent first curved sections 104 at one end thereof, and is attached and connected to the second main plate 12 at the other end thereof. The second main plate 12 includes at least one second curved section 105 that is disposed to correspond to the at least one first curved section 104.

In the header as described above, the first rib 103 is provided to increase the strength of the header. Further, the first rib 103 is attached to the second main plate 12 so as to increase a welding area between the first main plate 11 and the second main plate 12. The first curved sections 104 and the second curved section 105 are provided to increase the strengths of the first main plate 11 and the second main plate 12. Therefore, the header 100 has a strong ability to withstand pressure.

Figure 23:
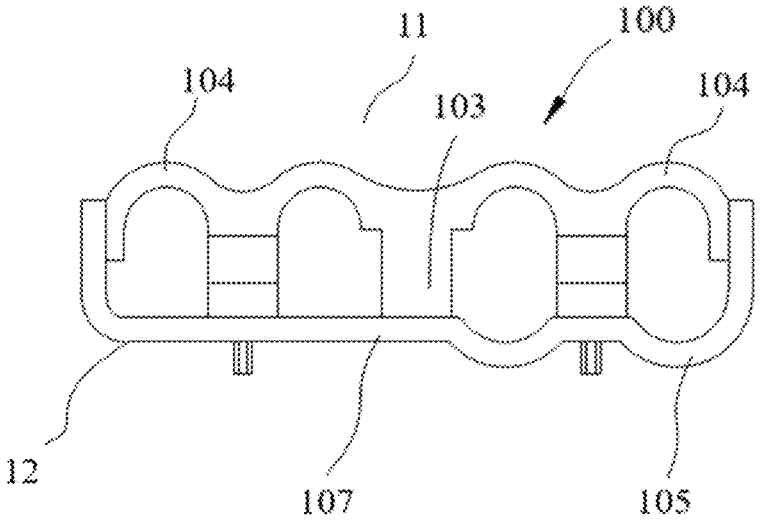
FIG. 23 is a schematic structural view of a second type of header according to the ninth embodiment of the disclosure.

FIG. 23 is a schematic structural view of a second type of header according to the ninth embodiment of the present disclosure. As shown in FIG. 23, in this embodiment, the second main plate 12 includes a first straight section 107 connected to the second curved section 105, and the second curved section 105 corresponds to the first curved section 104. The first straight section 107 is at least partially attached to the first rib 103. The first straight section 107 is at least partially attached to the first rib 103 so that the welding area between the first main plate 11 and the second main plate 12 is further increased, thereby improving the strength of the header 100.

Figure 24:
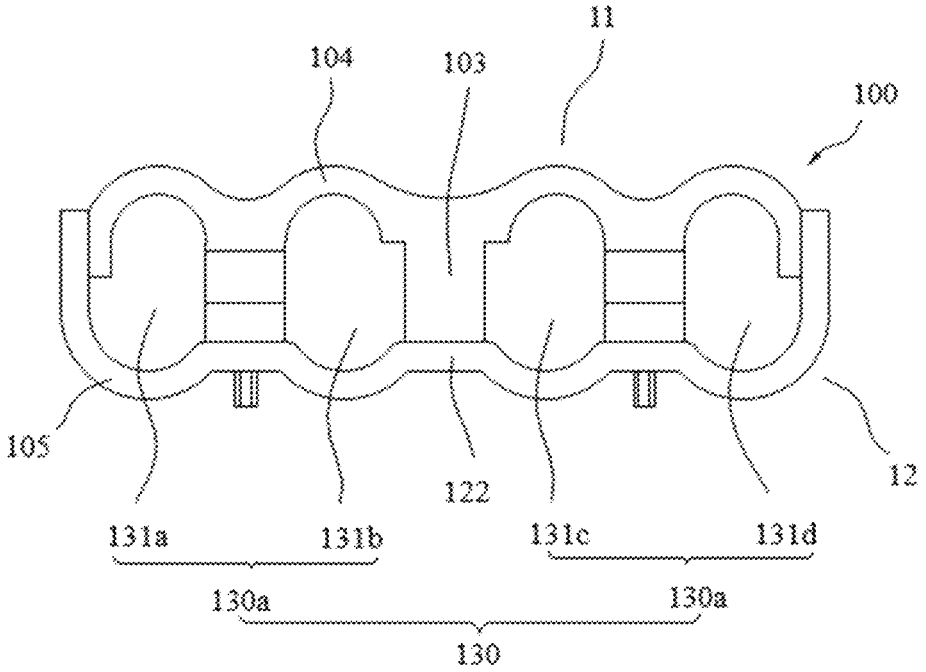
FIG. 24 is a schematic structural view of a third type of header according to the ninth embodiment of the present disclosure.
Figure 25:
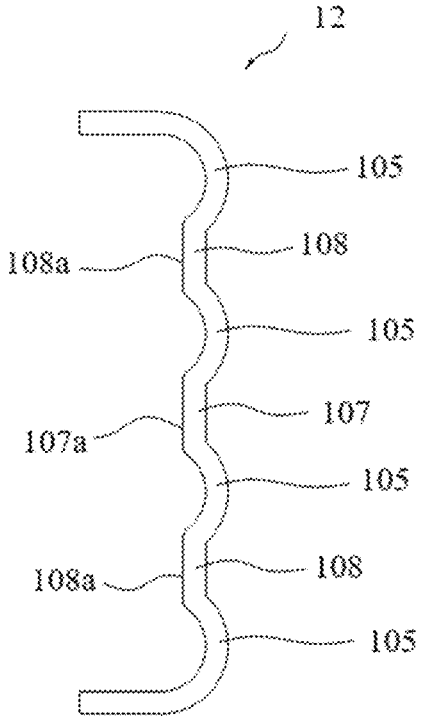
FIG. 25 is a schematic structural front view of a second main plate of the third type of header according to the ninth embodiment of the present disclosure.
Figure 26:
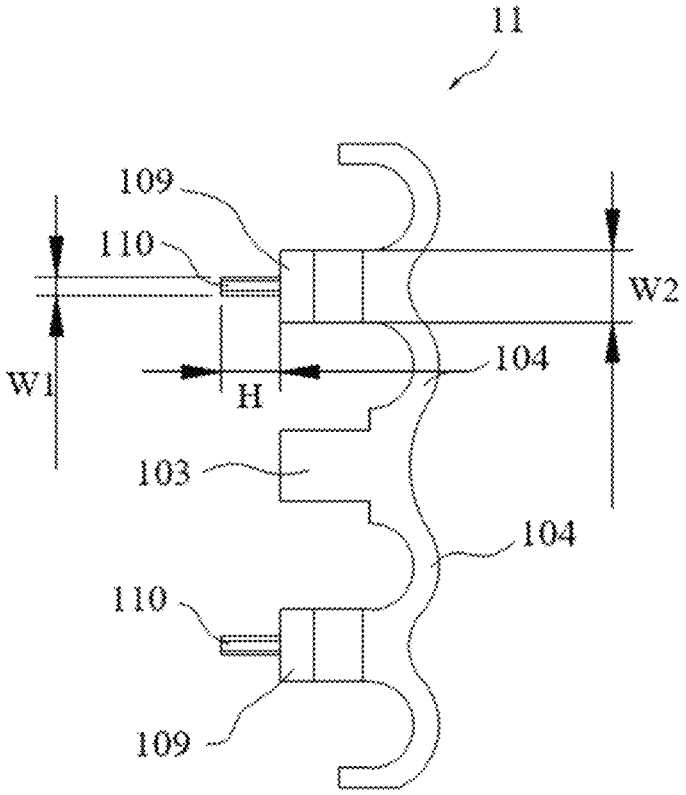
FIG. 26 is a schematic structural front view of a first main plate of the third type of header according to the ninth embodiment of the present disclosure.

FIG. 24 is a schematic structural view of a third type of header according to the ninth embodiment of the present disclosure, FIG. 25 is a schematic front structural view of a second plate in the third type of header according to the ninth embodiment of the present disclosure, and FIG. 26 is a schematic front structural view of a first plate in the third type of header according to the ninth embodiment of the present disclosure. As shown in FIGS. 24 to 26, in this embodiment, the first main plate 11 includes a first rib 103 and two or more first curved sections 104. The second main plate 12 includes a first straight section 107 and two or more second curved sections 105. The first straight section 107 is connected with two adjacent second curved sections 105. The second curved sections 105 are disposed in a one-to-one correspondence with the first curved sections 104. The first straight section 107 is attached to the first rib 103. In this embodiment, the second curved sections 105 are disposed in a one-to-one correspondence with the first curved sections 104, so that the strength of the header 100 is further improved.

In this embodiment, referring to FIG. 25, the first straight section 107 may include a first fitting surface 107*a*, to which an end surface of the first rib 103 is attached. Referring to FIG. 24, a first cavity 130 is formed between the first main plate 11 and the second main plate 12. The first cavity 130 includes at least two chambers 130*a*, and the first rib 103 is located between two adjacent chambers 130*a*.

In this embodiment, the first rib 103 may be a strip-shaped rib with a flat end surface. The first fitting surface 107*a* is a flat surface. The flat surface of the first rib 103 is attached to the flat surface of the first fitting surface 107*a*, thereby increasing the welding area.

In an alternative embodiment, the second main plate 12 further includes second straight sections 108, each of which is connected to the second curved section 105 or the first straight section 107. Each of the second straight sections 108 includes a second fitting surface 108*a*. The first main plate 11 further includes second ribs 109. Alternatively, each of the second ribs 109 may be a strip-shaped rib with a flat end surface. Each of the second ribs 109 is connected to two adjacent first curved sections 104 at one end thereof, and is attached to the second fitting surface 108*a* with an end surface of the other end thereof.

Each of the chambers 130*a* includes two or more sub-chambers, and each of the second ribs 109 are located between two adjacent sub-chambers.

It should be understood that the second ribs 109 are located in the chambers 130*a*. Alternatively, each of the second ribs 109 may be formed with a communication groove or a communication aperture to communicate two adjacent sub-chambers. Each second rib 109 may be partially formed with the communication groove or the communication aperture to cooperate with the partition structure, such that partial regions of the two adjacent sub-chambers communicate with each other and another partial regions of the two adjacent sub-chambers are independent from each other to form different flow paths.

The second ribs 109 are configured to further increase the strength of the header 100 so as to withstand a pressure of a refrigerant. Alternatively, the second ribs 109 may be arranged symmetrically with respect to the first rib 103 as a center axis. Each of the second ribs 109 is configured to divide the chambers 130*a* into two sub-chambers. However, the second ribs 109 may also be arranged asymmetrically with respect to the first rib 103, which can also further increase the strength of the header 100. The following description will take a four-flow-path and a three-flow-path as examples.

In an alternative embodiment, at least one of the first rib 103 or the second ribs 109 are provided with a third rib 110, as shown in FIG. 26. It should be understood that the third rib 110 is formed by extending at least one of the first rib 103 or the second ribs 109 in a direction away therefrom. For example, the first rib 103 is disposed on the first main plate 11, and the third rib 110 is formed by extending the first rib 103 toward the second main plate 12 in a direction away from an end of the first main plate 11.

Alternatively, the third rib 110 may be a strip-shaped rib, a triangular rib or other ribs. The third rib 110 may be disposed at any position of an end of the first rib 103, and/or may be disposed at any position of an end of the second rib 109. At least one of the first straight section 107 or the second straight section 108 is provided with a fitting aperture 108*b* (refer to FIG. 27), and the third rib 110 is fixed in the fitting aperture 108*b*. The third rib 110 is configured to further improve the strength of the header 100. Alternatively, after the third rib 110 is fitted into the fitting aperture 108*b*, a portion of the third rib 110 penetrating through the fitting aperture 108*b* can be further twisted and fixed, which improves the connection strength between the first main plate 11 and the second main plate 12.

In this embodiment, for example, the third rib 110 is provided at the second rib 109. As shown in FIGS. 23 to 27, each of the second ribs 109 is provided with a third rib 110 with a predetermined thickness and height. The thickness of the third rib 110 W1 may be ¼-½ of a thickness W2 of the second rib 109. In this way, after the third rib 110 is fitted with the fitting aperture 108*b*, the width of the second rib 109 is large enough to limit the position of the third rib 110, to ensure that the third rib 110 is reliably connected with the fitting aperture 108*b*. The height H of the third rib 110 may be within a range of 2 mm-9 mm. In this way, when the third rib 110 penetrates through the fitting aperture 108*b*, an exposed portion of the third rib 110 can be more convenient to be clamped by a tool for twisting. The twisted third rib 110 further increases the connection strength between the first main plate 11 and the second main plate 12.

The third rib 110 is tightly connected with the fitting aperture 108*b* of the second main plate 12 to fix, position and connect the first main plate 11 and the second main plate 12, which improves the reliability of the connection between the first main plate 11 and the second main plate 12.

It should be understood that the third rib 110 may be disposed only at the first rib 103. In this case, the first straight section 107 is correspondingly provided with the fitting aperture 108*a*. Alternatively, the third rib 110 may be disposed only at the second rib 109. In this case, the second straight section 108 is correspondingly provided with the fitting aperture 108*b*. Alternatively, the third rib 110 may also be disposed both at the first rib 103 and the second rib 109. In this case, each of the first straight section 107 and the second straight section 108 is formed with a respective fitting aperture. It should be noted that the present disclosure is not limited to the above embodiments as long as the reliability of the connection between the first main plate 11 and the second main plate 12 can be improved.

Figure 33:
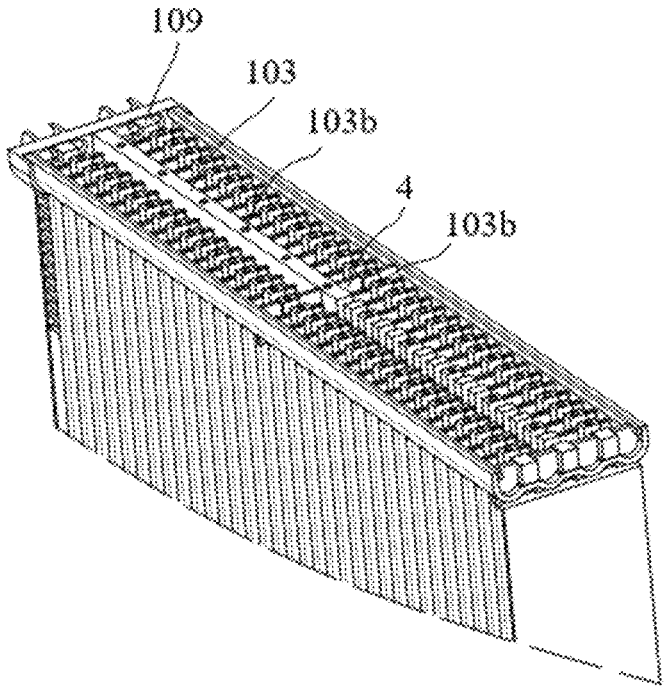
FIG. 33 is a schematic partial view of FIG. 32.

It should be understood that referring to FIG. 33, in a length direction of the first rib 103 or the second rib 109, the third ribs 110 may be continuously distributed on at least one of the first rib 103 or the second ribs 109, or distributed on at least one of the first rib 103 or the second ribs 109 at a predetermined interval. The third ribs 110 may be evenly or unevenly distributed, or the third ribs 110 may be densely or sparsely distributed. The third ribs 110 may be distributed on the first rib 103 and the second ribs 109 in the same manner or different manners. It should be noted that the present disclosure is not limited to the above embodiments as long as the reliability of the connection between the first main plate 11 and the second main plate 12 can be improved.

Figure 27:
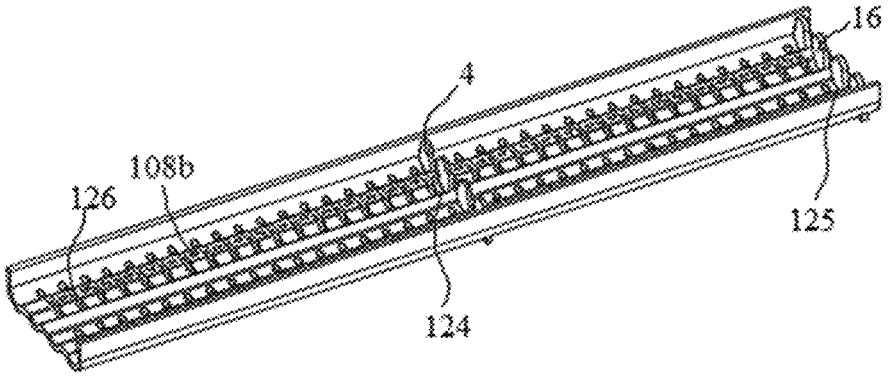
FIG. 27 is a schematic structural view of the second main plate of the third type of header according to the ninth embodiment of the present disclosure.
Figure 28:
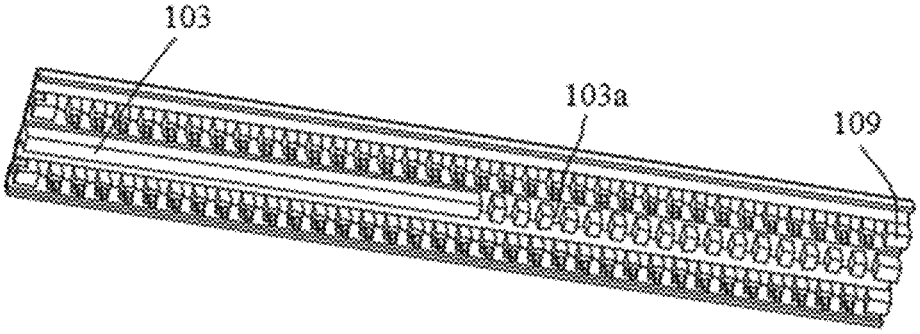
FIG. 28 is a schematic structural view of the first main plate of the third type of header according to the ninth embodiment of the present disclosure.

FIG. 27 is a schematic structural view of a second main plate of a third type of header according to an embodiment of the present disclosure, and FIG. 28 is schematic structural view of a first main plate of the third type of header according to the embodiment of the present disclosure. As shown in FIGS. 27 and 28, in an alternative implementation, the second main plate 12 is provided with partition plate grooves 124, and the header 100 further includes the first partition plates 4 (see FIGS. 21 and 33). One of the partition plates 4 is fixed into one of the partition plate grooves 124. Referring to FIG. 28, the first rib 103 of the first main plate 11 is formed with communication grooves 103*a* located at a side of each of the first partition plates 4. The adjacent chambers 130*a* are in communication with each other through the communication groove 103*a*. The chambers 130*a* are isolated from each other at the other side of the first partition plate 4. It should be appreciated for those skilled in the art that the chambers 130*a* may also be in communication with each other by providing communication apertures, and the present disclosure is not limited to the above communication grooves 103*a*.

The header 100 may be provided with a plurality of groups of first partition plates 4. The plurality of groups of first partition plates 4 corporate with the partition plate grooves 124 to divide each of the chambers 130*a* into a plurality of sub-chambers in a length direction of the header 100. With these sub-chambers, the refrigerant is capable of flowing in a plurality of flow paths. Each of the first partition plates 4 may also be an integrated structure and corporate with the partition plate groove 124 as a whole. The first partition plate 4 with the integrated structure may also divide the cavity 130*a* into the plurality of sub-chambers in the length direction of the header 100, so that the refrigerant can flow in the plurality of flow paths through the plurality of sub-chambers. A flow process of the multi-flow-path will be described in detail below.

Figure 31:
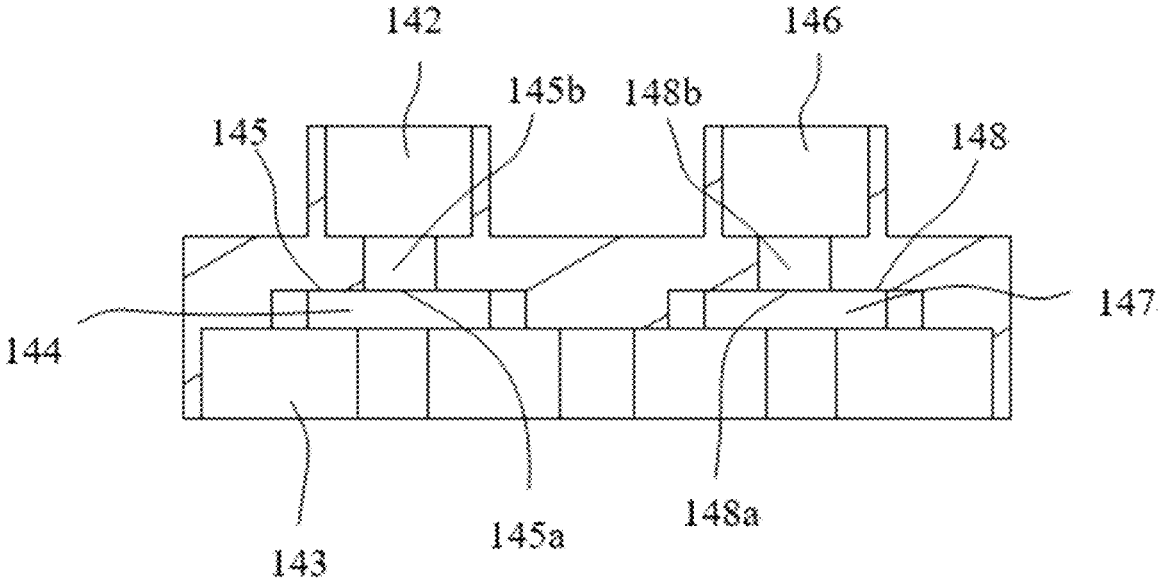
FIG. 31 is a schematic cross-sectional view of the end cap of the header according to the ninth embodiment of the present disclosure.
Figure 32:
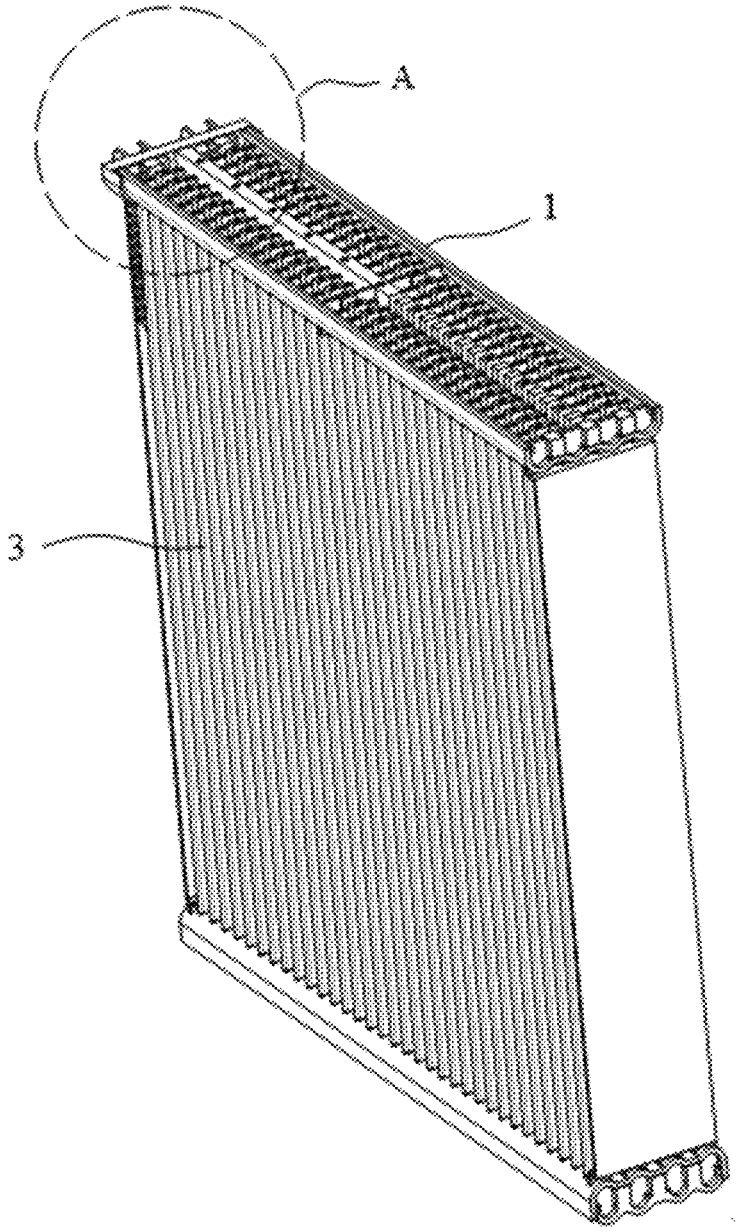
FIG. 32 is a schematic sectional view of the first header fitting with heat exchange tubes after being partially cut off, according to the ninth embodiment of the present disclosure.

As shown in FIG. 27, the first main plate 11 or the second main plate 12 may also be provided with receiving grooves 126. Alternatively, the receiving grooves 126 may be obtained by punching press of a puncher, or may be integrally formed by casting or the like. Each of the receiving grooves 126 matches a necking portion 43 of the respective heat exchange tube 3 in shape and size. Specifically, the receiving grooves 126 may be, for example, an opening in a rectangular shape or a waist shape. The heat exchange tube 3 is usually a flat tube. Referring to FIGS. 31 and 32, the heat exchange tube 3 of the flat tube shape has the necking portion 43 that is inserted into a respective one of the receiving grooves 126.

As shown in FIG. 27, in this embodiment, the receiving grooves 126 are formed at the second main plate 12. Correspondingly, each of the second ribs 109 on the first main plate 11 may be provided with a notch to avoid an end of each of the heat exchange tubes 3. The notch has a width matching a thickness of the necking portion 43 of the heat exchange tube 3 such that at least part of the necking portion 43 is received in the notch. When the at least part of the necking portion 43 of the heat exchange tube 3 is inserted into the notch, an insertion depth of the necking portion 43 is configured in a manner that an end of the necking portion 43 cannot contact an inner wall of the notch and the flow of the refrigerant cannot be interfered. It should be understood that the first main plate 11 may also be formed with the receiving grooves, and the second main plate 12 may be provided with the second ribs 109 and the notches. The present disclosure is not limited thereto.

In this embodiment, an end of each of the heat exchange tubes 3 is received in one of the notches. However, the ends of two or more heat exchange tubes 3 may be received in the one of the notches. In this case, the width of the notch is greater than or equal to a sum of a distance between two or more heat exchange tubes 3 and a thickness of all the heat exchange tubes 3, as long as the ends of the necking portions 43 of all the heat exchange tubes 3 cannot contact with the inner wall of the notch and the flow of the refrigerant cannot be interfered.

In this embodiment, the heat exchange tubes 3 may be fixed to the second main plate 12 by brazing after being inserted into the receiving grooves 126.

Figure 29:
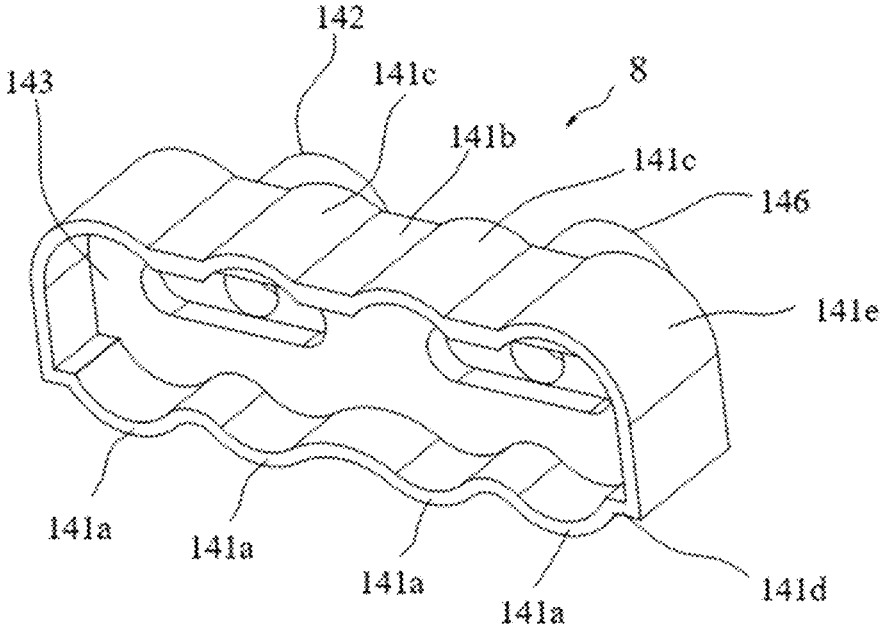
FIG. 29 is a schematic structural view of an end cap of the header according to the ninth embodiment of the present disclosure.
Figure 30:
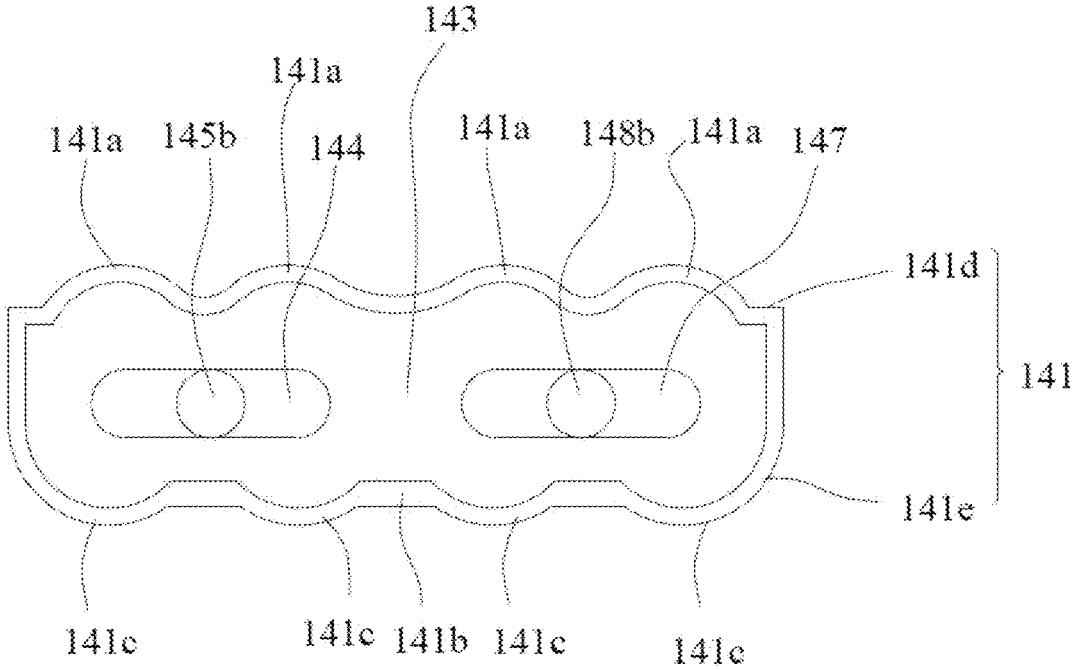
FIG. 30 is a schematic front view of the end cover of the header according to the ninth embodiment of the present disclosure.

FIG. 29 is a schematic structural view of an end cap of the header according to the embodiment of the present disclosure, FIG. 30 is a schematic front view of the end cover of the header according to the embodiment of the present disclosure, and FIG. 31 is a schematic transverse sectional view of the end cover of the header according to the embodiment of the present disclosure.

Referring to FIGS. 21, 29 to 31, a header 100 according to an embodiment of the present disclosure further includes a blocking cap 16 and an end cap 8. The blocking cap 16 is configured to at least block an end of the first cavity 130, and the end cap 8 is disposed at the other end of the first cavity 130 without the blocking cap 16. The end cap 8 has an inlet and/or an outlet that communicate with the first cavity 130, respectively. The inlet is configured for an inflow of the refrigerant, and the outlet is configured for an outflow of the refrigerant. The end cap 8 is assembled with the first header 1 or the second header 2 to form a header assembly.

It should be understood that the inlet and the outlet may be disposed on the same end cap, or may be disposed on two end covers, respectively. The present disclosure is not limited to the above embodiments as long as the inflow and outflow of the refrigerant will not be interfered.

Referring to FIG. 27, a blocking cap groove 125 may be provided at the second main plate 12. The blocking cap 16 is fitted with the blocking cap groove 125 to seal the end at a side of the header 100. In this embodiment, the first header 1 of the heat exchanger is provided with the blocking cap 16 at one end thereof and the end cap 8 at the other end thereof. The second header 2 of the heat exchanger may be provided with the blocking caps 16 at both ends. However, the blocking cap 16 and the end cap 8 may also be arranged based on an actual flow path design, which is not further limited herein.

Figure 34:
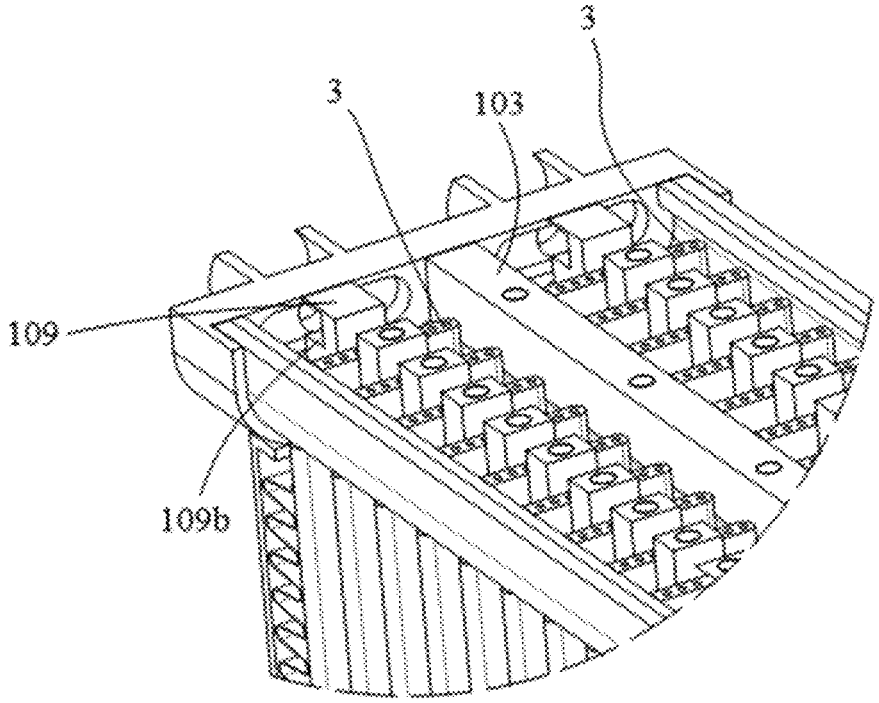
FIG. 34 is a schematic enlarged view of a part A in FIG. 32.
Figure 35:
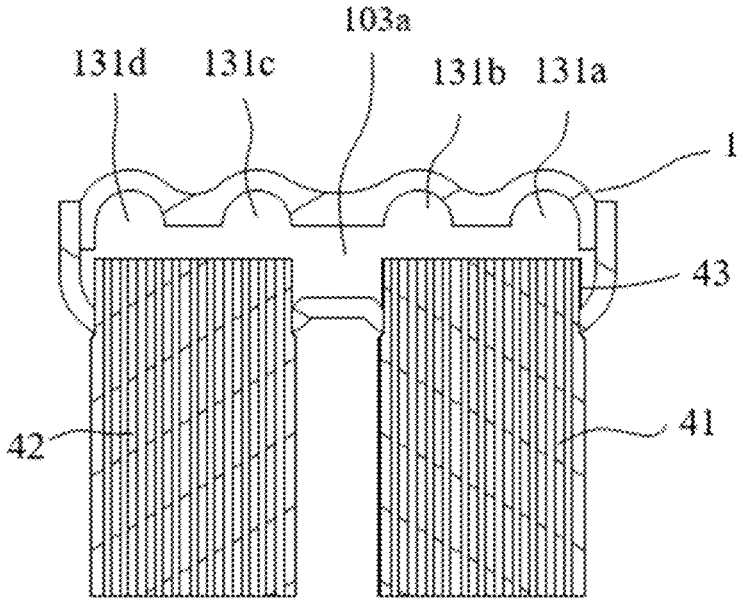
FIG. 35 is a schematic sectional view of the first header fitting with the heat exchange tubes according to the ninth embodiment of the present disclosure.

FIG. 32 is a schematic sectional view of the first header fitting with the heat exchange tubes after being partially cut off, according to the embodiment of the present disclosure. FIG. 33 is a schematic partial view of the first header shown in FIG. 32. FIG. 34 is a schematic enlarged view of a part A shown in FIG. 32. FIG. 17 is a schematic sectional view of the first header fitting with the heat exchange tubes according to an embodiment of the present disclosure.

Taking a four-flow-path as an example and referring to FIGS. 19, 20, 27, 28, and 35, the first header 1 of the heat exchanger according to the embodiment of the present disclosure includes a first end A1 and a second end A2. The second header 2 includes a third end A3 and a fourth end A4. The first end A1 and the third end A3 are located at the same side, and the second end A2 and the fourth end A4 are located at the same side. In this embodiment, the inlet and the outlet are both located at the first end A1, and the second end A2, the third end A3, and the fourth end A4 are all provided with the blocking caps. The first header 1 is provided with the first partition plates 4. A part of the first rib 103 of the first header 1 located between the first partition plates 4 and the second end A2 are formed with communication grooves 103*a*, and a part of the first rib 103 of the first header 1 located between the first partition plates 4 and the second end A2 are not formed with a communication groove. In addition, the first rib of the second header 2 is not formed with a communication groove. An operation principle of the four-flow-path of the heat exchanger according to the embodiment of the present disclosure as an evaporator will be described below.

Firstly, a refrigerant flows into a sub-chamber 131*c* and a sub-chamber 131*d* (as shown in FIG. 24) of the first header 1 between the first partition plates 4 and the first end A1 through the inlet. At this time, as shown in FIGS. 20 and 21, the refrigerant flows in a first flow path. In this first flow path, the refrigerant flows downwardly to a sub-chamber 131*c* and a sub-chamber 131*d* of the second header 2 located between the first partition plates 4 and the third end A3 along rear tubes 42 communicating with the sub-chamber 131*c* and the sub-chamber 131*d* located between the first partition plates 4 and the first end A1, and the refrigerant exchanges heat with the air to evaporate and absorb heat. It should be noted that the second header 2 is not provided with the first partition plate 4, and the phrase "between the first partition plates 4 and the third end A3" refers to between the third end A3 and a projection of the first partition plates 4 on the third header 3.

Thereafter, the refrigerant flows into a sub-chamber 131*c* and a sub-chamber 131*d* of the second header 2 between the first partition plates 4 and the fourth end A4, and flows in a second flow path. It should be noted that the second header 2 is not provided with the first partition plate 4, and the phrase "between the first partition plates 4 and the third end A3" refers to between the third end A3 and the projection of the first partition plates 4 on the third header 3. The refrigerant flows upwardly along the rear tubes 42 communicating with the sub-chamber 131*c* and the sub-chamber 131*d* between the first partition plates 4 and the fourth end A4, and continues to evaporate and absorb the heat.

Next, the refrigerant flows to a sub-chamber 131*c* and a sub-chamber 131*d* of the first header 1 between the second end A2 and the first partition plates 4. With the communication grooves 103*a*, the refrigerant flows from a sub-chamber 131*c* and a sub-chamber 131*d* of the first header 1 between the second end A2 and the first partition plates 4 into a sub-chamber 131*a* and the sub-chamber 131*b* of the first header 1 between the second end A2 and the first partition plates 4, and then flows in a third flow path. The refrigerant flows downwardly to a sub-chamber 131*a* and a sub-chamber 131*b* of the second header 2 between the fourth end A4 and the first partition plates 4 along front tubes 41 communicating with a sub-chamber 131*a* and a sub-chamber 131*b* between the second end A2 and the first partition plates 4.

Subsequently, the refrigerant flows into a sub-chamber 131*a* and a sub-chamber 131*b* of the second header 2 between the third end A3 and the first partition plates 4, and flows in a fourth flow path. The refrigerant flows upwardly along the front tubes 41 communicating with a sub-chamber 131*a* and a sub-chamber 131*b* of the second header 2 between the third end A3 and the first partition plates 4, and flows out of the outlet communicating with a sub-chamber 131*a* and a sub-chamber 131*b* of the first header 1 between the first end A1 and the first partition plates 4.

An operation principle of the four-flow-path of the heat exchanger according to the embodiment of the present disclosure as a condenser will be described below.

Firstly, the refrigerant flows into the sub-chamber 131*a* and the sub-chamber 131*b* of the first header 1 between the first end A1 and the first partition plates 4 through the inlet. At this time, the refrigerant flows in a first flow path. The refrigerant flows downwardly to the sub-chamber 131*a* and the sub-chamber 131*b* of the second header 2 between the first partition plates 4 and the third end A3 along the front tubes 41 communicating with the sub-chamber 131*a* and the sub-chamber 131*b* between the first partition plates 4 and the first end A1, and the refrigerant is cooled and liquefied. It should be noted that the second header 2 is not provided with the first partition plate 4, and the phrase "between the first partition plates 4 and the third end A3" refers to between a projection of the first partition plates 4 on the third header 3 and the third end A3.

Thereafter, the refrigerant flows into the sub-chamber 131*a* and the sub-chamber 131*b* of the second header 2 between the first partition plates 4 and the fourth end A4, and flows in a second flow path. It should be noted that the second header 2 is not provided with the first partition plate 4, and the phrase "between the first partition plates 4 and the fourth end A4" refers to between a projection of the first partition plates 4 on the third header 3 and the fourth end A4. The refrigerant flows upwardly to the sub-chamber 131*a* and the sub-chamber 131*b* of the first header 1 between the first partition plates 4 and the second end A2 along the front tubes 41 communicating with the sub-chamber 131*a* and the sub-chamber 131*b* between the first partition plates 4 and the fourth end A4. With the communication grooves 103*a*, the refrigerant flows from the sub-chamber 131*a* and the sub-chamber 131*b* of the first header 1 between the first partition plates 4 and the second end A2 to the sub-chamber 131*c* and the sub-chamber 131*d* of the first header 1 between the first partition plates 4 and the second end A2.

Next, the refrigerant flows in a third flow path. The refrigerant flows downwardly along the rear tubes 42 communicating with the sub-chamber 131*c* and the sub-chamber 131*d* of the first header 1 between the first partitions 4 and the second end A2, and is cooled and liquefied.

Finally, the refrigerant flows to the sub-chamber 131*c* and the sub-chamber 131*d* of the second header 2 between the fourth end A4 and the first partition plates 4, and flows in a fourth flow path. Then, the refrigerant flows upwardly along the rear tubes 42 communicating with the sub-chamber 131*c* and the sub-chamber 131*d* between the fourth end A4 and the first partition plates 4, and flows out of the outlet communicating with the sub-chamber 131*c* and the sub-chamber 131*d* of the first header between the first end A1 and the first partition plates 4.

In this embodiment, as shown in FIGS. 29 to 31, the end cap 8 includes a body 141 and a first opening 142 formed at the body 141.

The first opening 142 may be a circular opening or other openings, and may be directly formed at the body 141 or connected to a pipe body on the body 141. A channel of the pipe body may be formed as the first opening 142.

The body 141 further includes a second cavity 143 and a first groove portion 144. The first groove portion 144 is located between the first opening 142 and the second cavity 143. The first groove portion 144 includes a first bottom wall 145 close to the first opening 142. The first bottom wall 145 includes a third opening 145*a* to communicate the first opening 142 with the second cavity 143. The second cavity 143 is in communication with the inner cavity of the first header 1 or the inner cavity of the second header 2. The first opening 142 is farther from the inner cavity of the first header 1 or the inner cavity of the second header 2 than the second cavity 143. A flow area of the first groove portion 144 is greater than that of the third opening 145*a*. The flow area herein refers to a volume of the fluid flowing through a flow cross-section per unit time. For example, in this embodiment, the flow area of the first groove portion 144 refers to a volume of the fluid flowing through a flow cross-section of the first groove portion 144 per unit time.

The first opening 142 of the end cap 8 may be used as a refrigerant inlet or a refrigerant outlet, which is not limited thereto. In a case where the first opening 142 is used as the inlet, when the refrigerant flows from the first opening 142 into the first groove portion 144 through the third opening 145*a*, since the flow area of the first groove portion 144 is greater than that of the third opening 145*a*, an impact of the refrigerant flowing into the first cavity 130 of the header 100 on the header 100 is reduced during the inflow of the refrigerant and thus the pressure-resistant requirement of the header 100 is reduced.

When the first opening 142 is used as the outlet, the refrigerant can flow from the first groove portion 144 into the fourth opening 145*a* at a more uniform flow rate.

In an alternative implementation, a width of the first groove portion 144 in a transverse extension direction of the first bottom wall 145 is greater than a width of the third opening 145*a* in the transverse extension direction of the first bottom wall 145. In this embodiment, the first groove portion 144 may be a waist-shaped groove, and the third opening 145*a* may be a circular aperture. A dimension of a major axis of the waist-shaped groove is greater than a diameter of the circular aperture. Alternatively, a dimension of a minor axis of the waist-shaped groove may be equal to the diameter of the circular aperture. However, the dimension of the minor axis of the waist-shaped groove may be greater or less than the diameter of the circular aperture, as long as the third opening 145*a* can communicate the first opening 142 with the second cavity 143. Alternatively, a center of the third opening 145*a* is coincident with that of the first groove portion 144, such that the refrigerant is capable of being evenly diverted toward both sides when flowing out of the third opening 145*a*, thereby achieving uniform diverted flows. However, the first groove portion 144 may have other shapes, such as a rectangular shape and a circular shape, and the third opening 145*a* may be an aperture of other shapes, such as a profiled aperture or an elliptical aperture.

In an alternative implementation, the body 141 further includes a first channel 145*b* that is formed by extending the third opening 145*a* in a direction from the second cavity 143 toward the first opening 142. The first channel 145*b* is located between the first opening 142 and the first groove portion 144, and is in communication with the first opening 142 and the first groove portion 144, respectively. A width of the first channel 145*b* in the transverse extension direction of the first bottom wall 145 is smaller than that of the first groove portion 144 in the transverse extension direction of the first bottom wall 145.

For example, the first opening is a circular opening, the first channel 145*b* is a circular channel and an external pipeline is a circular pipe. An inner diameter of the first channel 145*b* may be the same as an opening diameter of the third opening 145*a*. The external pipeline for the inflow of the refrigerant is inserted into the first opening 142, and an inner diameter of the external pipeline is equal to an inner diameter of the first channel 145*b*. After flowing into the heat exchanger, the refrigerant passes through the first channel 145*b* at a smaller flow rate, and then flows into the first groove portion 144 through the third opening 145*a* to be diverted, thereby further reducing the impact of the refrigerant on the header 100.

In the embodiment as described above, the body 141 is formed with a second opening 146. The second opening 146 may be a circular opening or have other shapes. The second opening 146 may be directly formed at the body 141 or connected to the pipe body on the body 141, and the channel of the pipe body may be formed as the second opening 146.

The body 141 further includes a second groove portion 147. The second groove portion 147 includes a second bottom wall 148 close to the second opening 146. The second bottom wall 148 includes a fourth opening 148*a* that is configured to communicate the second opening 146 with the second cavity 143. A flow area of the second groove portion 147 is greater than that of the fourth opening 148*a*. The flow area herein refers to a volume of the fluid flowing through a flow cross-section per unit time. For example, in this embodiment, the flow area of the second groove portion 147 refers to a volume of the fluid flowing through a flow cross-section of the second groove portion 147 per unit time.

The second opening 146 of the end cap 8 may be used as a refrigerant inlet or a refrigerant outlet, which is not limited thereto. In a case where the second opening 146 is used as the refrigerant inlet, when the refrigerant flows from the second opening 146 into the second groove portion 147 through the fourth opening 148*a*, since the flow area of the second groove portion 147 is greater than that of the fourth opening 148*a*, an instantaneous pressure of the refrigerant is capable of being reduced during the inflow of the refrigerant. In this way, the impact of the refrigerant on the header 100 can be reduced when the refrigerant flows into the first cavity 30 of the header 100.

When the second opening 146 is used as the refrigerant outlet, the refrigerant flows from the second groove portion 147 into the fourth opening 148*a* at a more uniform flow rate.

In an alternative implementation, a width of the second groove portion 147 in a transverse extension direction of the second bottom wall 148 is greater than a width of the fourth opening 148*a* in the transverse extension direction of the second bottom wall 148. In this embodiment, the second groove portion 147 may be a waist-shaped groove, and the fourth opening 148*a* may be a circular aperture. A dimension of a major axis of the waist-shaped groove is greater than a diameter of the circular aperture. Alternatively, a dimension of a minor axis of the waist-shaped groove may be equal to the diameter of the circular aperture. However, the dimension of the minor axis of the waist-shaped groove may also be greater or smaller than the diameter of the circular aperture, as long as the third opening can communicate the first opening with the second cavity. Alternatively, a center of the third opening is coincident with that of the first groove portion, such that the refrigerant is capable of being evenly diverted toward both sides when flowing out of the fourth opening 148*a* to the second groove portion 147, thereby achieving uniform diverted flows. However, the second groove portion 147 may also have other shapes, such as a rectangular shape and a circular shape, and the fourth opening 148*a* may be an aperture of other shapes, such as a profiled aperture or an elliptical aperture.

In an alternative implementation, the body 141 further includes a second channel 148*b* that is formed by extending the fourth opening 148*a* in a direction from the second cavity 143 toward the second opening 146. The second channel 148*b* is located between the second opening 146 and the second groove portion 147, and is configured to be in communication with the second opening 146 and the second groove portion 147, respectively. A width of the second channel 148*b* in the transverse extension direction of the second bottom wall 148 is smaller than that of the second groove portion 147 in the transverse extension direction of the second bottom wall 148.

For example, the second channel is a circular channel and an external pipeline is a circular pipe. An inner diameter of the second channel 148*b* may be the same as an opening diameter of the fourth opening 148*a*. When the second channel 148*b* is used as an input channel, the external pipeline for the inflow of the refrigerant is inserted into the second opening 146, and an inner diameter of the external pipeline is equal to an inner diameter of the second channel 148*b*. After flowing into the heat exchanger, the refrigerant passes through the second channel 148*b* at a smaller flow rate, and then flows into the second groove portion 147 through the fourth opening 148*a* to be diverted, thereby further reducing the impact of the refrigerant on the header 100.

In a case where the second channel 148*b* is used as an output channel, the refrigerant flows into the second channel 148*b* from the second groove portion 147, which achieves more uniform flow of the refrigerant.

In an alternative implementation, the first groove portion 144 and the second groove portion 147 may be symmetrically arranged about a center line of the end cap 8, which can result in more uniform distribution of the refrigerant. Similarly, the first channel 145*b* and the second channel 148*b* are symmetrically arranged about the center line of the end cap 8, and the third opening 145*a* and the fourth opening 148*a* are symmetrically arranged about the center line of the end cap 8, so as to achieve more uniform distribution of the refrigerant.

In this embodiment, the header 100 includes the first main plate 11 and the second main plate 12 connected with each other. The first cavity 130 is formed between the first main plate 11 and the second main plate 12. At least one of the first main plate 11 or the second main plate 12 is provided with a first rib 103. The first cavity 130 includes at least two chambers 130*a*, and the first rib 103 is disposed between adjacent chambers 130*a*.

The header 100 further includes the end cap 8 according to any one of the embodiments of the present disclosure. The end cap 8 is configured to block the first cavity 130 at one end of the first cavity, and the first opening 142 communicates with one of the chambers 130*a* through the first groove portion 144.

It should be understood that the header 100 may include an end cap 8 that only has the first opening 142, or may include an end cap that has both the first opening 142 and the second opening 146. When the end cap has both the first opening 142 and the second opening 146, the first ribs 103 abut against the body 141, and the first ribs 103 are located between the first opening 142 and the second opening 146 as well as between the first groove portion 144 and the second groove portion 147, to prevent the first opening 142 and the second opening 146 from being communicated with each other at the end cap. In the end cap 8, the flow area of the first groove portion 144 is greater than that of the third opening 145*a*. Therefore, the impact of the refrigerant on the header 100 will be further reduced when the refrigerant flows into the chambers 130*a* of the header 100.

Figure 36:
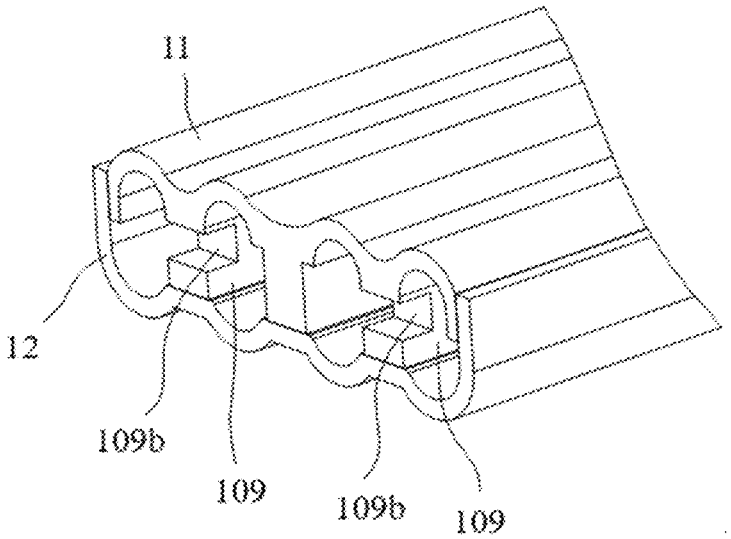
FIG. 36 is a schematic partial view of the header according to the ninth embodiment of the present disclosure.

As shown in FIGS. 28 and 33, in this embodiment, a distance from each of the first partition plates 4 to the end cap 8 is smaller than a length of a portion of the first rib 103 without the communication groove 103*a*. In this way, sealing performance at the first partition plates 4 is improved. However, the distance from each of the first partition plates 4 to the end cap 8 may be equal to the length of the portion of the first rib 103 without the communication groove 103*a*, and the present disclosure is not limited thereto. In this embodiment, the length of the portion of the first rib 103 without the communication groove 103*a* may be greater than that of a portion of the first rib 103 formed with the communication groove 103*a*. However, the length of the portion of the first rib 103 without the communication groove 103*a* may be smaller than or equal to that of the portion of the first rib 103 formed with the communication groove 103*a*, and the present disclosure is not limited thereto. FIG. 36 is a schematic partial view of a header according to an embodiment of the present disclosure. Referring to FIGS. 34 and 36, in an alternative implementation, at least one of the first main plate 11 or the second main plate 12 includes second ribs 109, and each of the chambers 130*a* includes two or more sub-chambers, and the second ribs 109 are located between two adjacent sub-chambers.

A width of the first groove portion 144 is greater than that of the second rib 109 facing the first groove portion 144. After the refrigerant flows out of the first groove portion 144, most of the refrigerant flows into the chambers 130*a* from both sides of the second rib 109, rather than vertically impacting the second ribs 109, thereby reducing the impact on the second ribs 109.

In an alternative implementation, an end of the second rib 109 facing toward the end cap 8 is formed with a third groove 109*b*. The third groove 109*b* functions to further prevent the refrigerant from directly impacting the second rib 109 after flowing out of the first groove portion 144.

Similarly, the third groove 109*b* is disposed such that when flowing out of the chamber 130*a*, the refrigerant will not be applied by excessive resistance, and thus can smoothly flow into the second cavity 143 and then flow out of the outlet.

It should be understood that the third groove 109*b* may be a square groove as shown in FIG. 36. However, the third groove 109*b* may also be a U-shaped or V-shaped groove, or other profiled grooves. The present disclose is not limited to the above embodiments as long as the third groove can prevent the refrigerant from directly impacting the second rib 109.

In an alternative implementation, as shown in FIGS. 24 to 26 and 29 to 31, the first main plate 11 includes two or more first curved sections 104, and the second main plate 12 includes a first straight section 107 and two or more second curved sections 105. The first straight section 107 is configured to connect two adjacent second curved sections 105, and each of the second curved sections 105 corresponds to one of the first curved sections 104. That is, the second curved section 105 and the first curved section 104 cooperate with each other, and are assembled with the first rib 103 or the second ribs 109 to form the sub-chambers as described above.

The body 141 includes an upper body 141*d* and a lower body 141*e*. The upper body 141*d* includes third curved sections 141*a* corresponding to the first curved sections 104. The lower body 141*e* includes third straight sections 141*b* corresponding the first straight section 107 and the second straight sections 108, and fourth curved sections 141*c* corresponding to the second curved sections 105. The third straight sections 141*b* are configured to connect two adjacent fourth curved sections 141*c*. One of the fourth curved sections 141*c* corresponds to a respective one of the third curved sections 141*a*.

In this embodiment, when the end cap 8 fits with the first main plate 11 and the second main plate 12, the third straight sections 141*b* of the end cap 8 is capable of being attached to the first straight section 107 and the second straight sections 108, the third curved sections 141*a* is capable of being attached to the first curved sections 104, and the fourth curved sections 141*c* is capable of being attached to the second curved sections 105.

The header 100 and the heat exchanger according to the embodiments of the present disclosure is capable of improving the overall strength of the header 100 and reducing the impact of the refrigerant on the header 100.

Figure 37:
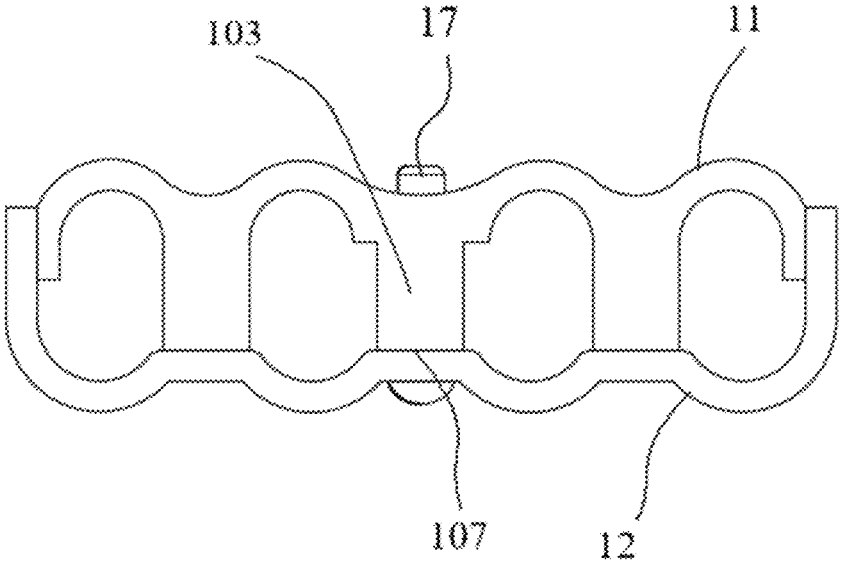
FIG. 37 is a schematic structural front view of a fifth type of header according to the ninth embodiment of the present disclosure.
Figure 38:
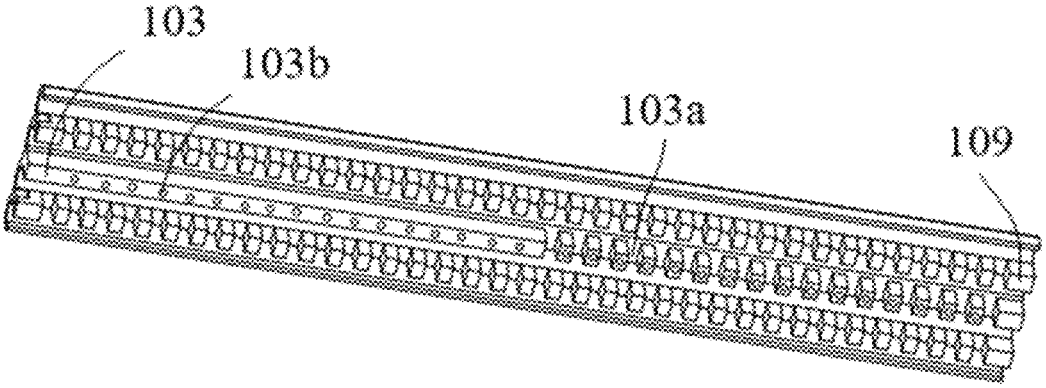
FIG. 38 is a schematic structural view of a first main plate of the fifth type of header according to the ninth embodiment of the present disclosure.
Figure 39:
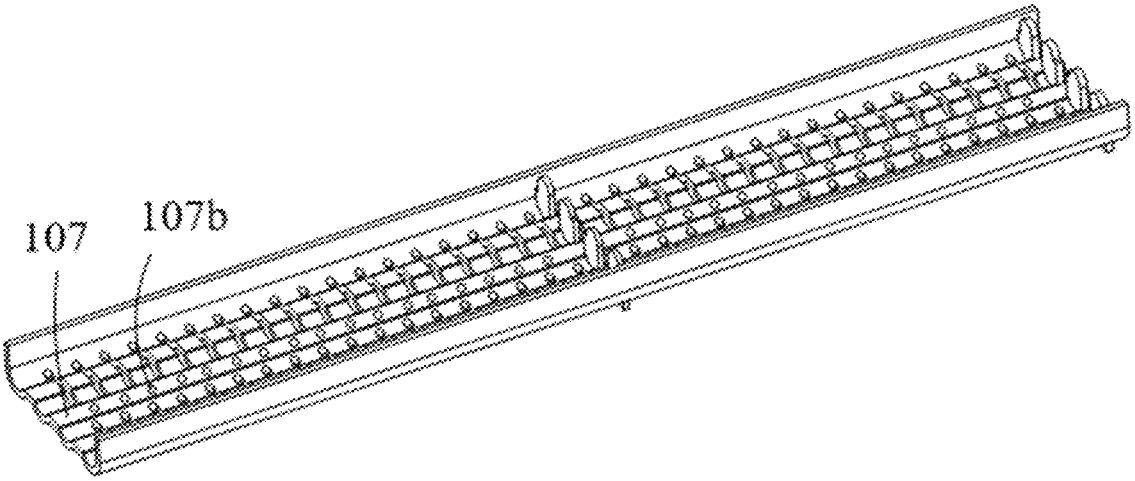
FIG. 39 is a schematic structural view of a second main plate of the fifth type of header according to the ninth embodiment of the present disclosure.

FIG. 37 is a schematic structural front view of a fifth type of header according to an embodiment of the present disclosure, FIG. 38 is a schematic structural view of a first main plate of the fifth type of header according to an embodiment of the present disclosure, and FIG. 39 is schematic structural view of a second main plate of the fifth type of header according to an embodiment of the present disclosure.

Referring to FIGS. 37 to 39, the header according to this embodiment is different from the headers as described in the above embodiments in that the first main plate 11 and the second main plate 12 are connected by a first fixing member 17.

Alternatively, the first rib 103 is provided with a first through hole 103*b*, and the first straight section 107 is provided with a second through hole 107*b*. The header includes the first fixing member 17 that is fixed to and penetrates through the first through hole 103*b* and the second through hole 107*b*. Alternatively, the first fixing member 17 may be a rivet or other fasteners.

In this embodiment, other structures of the first main plate 11 and the second main plate 12 are the same as those described in the above embodiments, and the detailed description thereof will be omitted herein.

In the header and heat exchanger according to the embodiment of the present disclosure, the first main plate 11 and the second main plate 12 are connected by the first fixing member, thereby improving the strength of the header.

Figure 40:
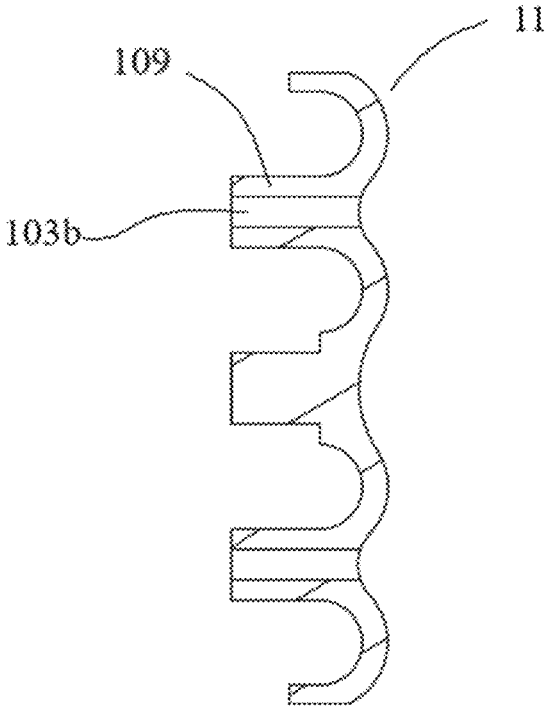
FIG. 40 is a schematic structural view of a first main plate of a sixth type of header according to the ninth embodiment of the present disclosure.
Figure 41:
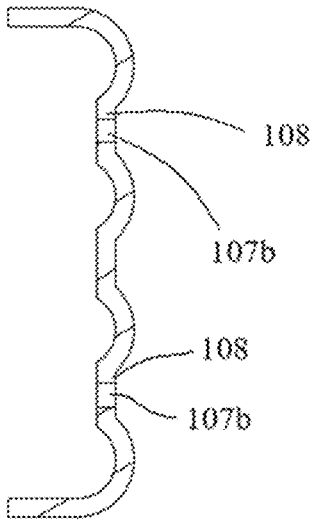
FIG. 41 is a schematic structural view of a second main plate of the sixth type of header according to the ninth embodiment of the present disclosure.
Figure 42:
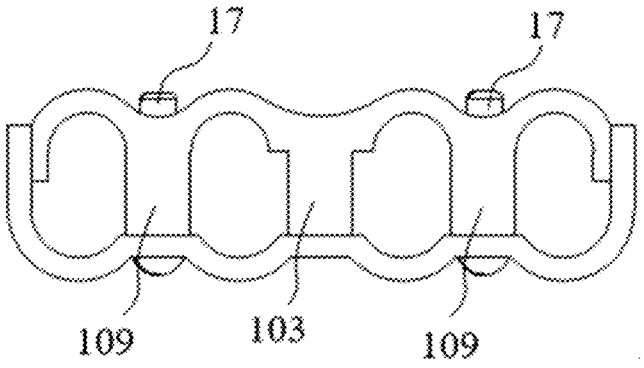
FIG. 42 is a schematic structural front view of the sixth type of header according to the ninth embodiment of the present disclosure.

FIG. 40 is a schematic structural view of a first plate of a sixth type of header according to an embodiment of the present disclosure, FIG. 41 is a schematic structural view of a second plate of the sixth type of header according to the embodiment of the present disclosure, and FIG. 42 is a schematic front structural view of the sixth type of header according to the embodiment of the present disclosure.

Referring to FIGS. 40 to 42, the header according to this embodiment is different from the headers as described in the above embodiments in that the first main plate 11 and the second main plate 12 are connected by first fixing members 17 in this embodiment. Specifically, each of the second ribs 109 is provided with a first through hole 103*b*, and each of the second straight sections 108 is provided with a second through hole 107*b*.

The header 100 includes the first fixing members 17, and each of the first fixing members 17 may be a rivet or other fasteners. The first fixing member 17 is fixed to and penetrates through a respective one of the first through holes 103*b* and a respective one of the second through holes 107*b*.

In this embodiment, other structures of the first main plate 11 and the second main plate 12 are the same as those described in the above embodiments, and the detailed description thereof will be omitted herein.

In the header according to the embodiment of the present disclosure, the first main plate 11 and the second main plate 12 are connected by the first fixing members 17, thereby improving the strength of the header.

It should be understood that, in other embodiments, the first rib 103 and the second rib 109 may be provided with the first through hole 103*b*, and the first straight section 107 and the second straight section 108 may be provided with the second through hole 107*b*. The first fixing member 17 is fixed to and penetrates through the first through hole 103*b* and the second through hole 107*b*. In the header according to this embodiment, a plurality of first fixing members 17 are provided to connect the first main plate 11 and the second main plate 12, which can further improve the strength of the header.

Referring to FIG. 33, the first through holes 103*b* may be continuously arranged on the second rib 109 as shown in FIG. 14, or may be arranged on the first ribs 103 at a predetermined interval, which is not further limited herein.

Figure 43:
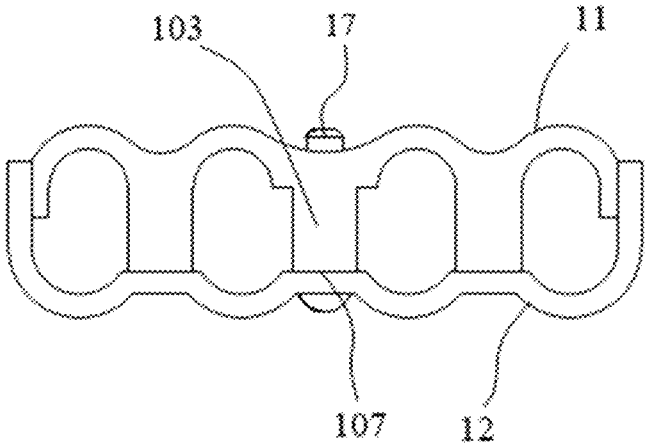
FIG. 43 is a schematic structural front view of a seventh type of header according to the ninth embodiment of the present disclosure.

FIG. 43 is a schematic structural front view of a seventh type of header according to an embodiment of the present disclosure. With the structure as described above, the first rib 111 may be provided with the first through hole 103*b*, and the second rib 109 may be provided with the third rib 110, so that the strength of the header is improved. However, the first rib 111 may be provided with the third rib 110, and the second rib 109 may be provided with the first through hole 103*b*.

It is noted that the above descriptions are only the preferred embodiments of the present disclosure and the technical principles thereof. It should be understood by those skilled in the art that the present disclosure is not limited to these specific embodiments described herein, and various changes, modifications and substitutions can be made by those skilled in the art without departing from the scope of the present disclosure. Therefore, although the present disclosure has been described in more detail by the above embodiments, the present disclosure is not limited to the above embodiments, and may also include more other equivalent embodiments without departing from the concept of the present disclosure. The scope of the present disclosure is defined by the appended claims.

What is claimed is:

1. A heat exchanger comprising a first header, a second header, heat exchange tubes, and an end cap, wherein each of the heat exchange tubes has an end connected to the first header and another end connected to the second header, an inner cavity of each of the heat exchange tubes communicates an inner cavity of the first header with an inner cavity of the second header, and each of the first header and the second header comprises two ports disposed in a length direction thereof;

wherein the end cap is assembled and fixed to one port of the two ports of the first header or one port of the two ports of the second header, and the end cap comprises a body and a first opening formed in the body;

wherein the body comprises a second cavity and a first groove portion, and the first groove portion is located between the first opening and the second cavity;

wherein the first groove portion comprises a first bottom wall close to the first opening, the first bottom wall is provided with a third opening communicating the first opening with the second cavity, the second cavity is in communication with the inner cavity of the first header or the inner cavity of the second header, the first opening is located farther from the inner cavity of the first header or the inner cavity of the second header than the second cavity, and the first opening is configured for inflow or outflow of a refrigerant;

wherein a width of the third opening in a transverse extension direction of the first bottom wall is smaller than a width of the first groove portion in the transverse extension direction of the first bottom wall; and wherein a flow area of the first groove portion is greater than a flow area of the third opening.

2. The heat exchanger according to claim 1, wherein the body further comprises a first channel that is formed by extending the third opening in a direction from the second cavity toward the first opening;

the first channel is located between the first opening and the first groove portion, and is in communication with the first opening and the first groove portion; and a width of the first channel in the transverse extension direction of the first bottom wall is smaller than a width of the first groove portion in the transverse extension direction of the first bottom wall.

3. The heat exchanger according to claim 2, wherein the body is formed with a second opening and further comprises a second groove portion;

the second groove portion comprises a second bottom wall close to the second opening, the second bottom wall comprises a fourth opening configured to communicate the second opening with the second cavity; and a flow area of the second groove portion is greater than a flow area of the fourth opening.

4. The heat exchanger according to claim 3, wherein the body further comprises a second channel that is formed by extending the fourth opening in a direction from the second cavity toward the second opening;

the second channel is located between the second opening and the second groove portion, and is in communication with the second opening and the second groove portion; and a width of the fourth opening in a transverse extension direction of the second bottom wall and a width of the second channel in the transverse extension direction of the second bottom wall are both smaller than a width of the second groove portion in the transverse extension direction of the second bottom wall.

5. The heat exchanger according to claim 1, wherein the first header comprises a first main plate and a second main plate connected with each other; and a first cavity is formed between the first main plate and the second main plate;

the first cavity comprises at least one first flow passage and at least one second flow passage that are arranged in parallel in a direction perpendicular to a longitudinal direction of the first header, and the at least one first flow passage has a total volume greater than a total volume of the at least one second flow passage; and the heat exchange tubes are arranged in a plurality of rows, one of the at least one first flow passage is in communication with at least one row of the plurality of rows of heat exchange tubes, and one of the at least one second flow passage is in communication with at least another row of the plurality of rows of heat exchange tubes.

6. The heat exchanger according to claim 5, wherein the first main plate comprises a middle rib configured to divide the first main plate into a plurality of through grooves and the at least one first flow passage and the at least one second flow passage are formed between the plurality of through grooves and the second main plate.

7. The heat exchanger according to claim 6, wherein the heat exchanger further comprises:

a first middle plate, the first middle plate being located between the first main plate and the second main plate, the first middle plate being provided with a plurality of rows of first elongated apertures, and the middle rib being attached to the first middle plate.

8. The heat exchanger according to claim 7, wherein the second main plate is provided with a plurality of rows of first heat exchange tube apertures, each first heat exchange tube aperture of which corresponds to one first elongated aperture of the plurality of rows of first elongated apertures; and an end of one of the heat exchange tubes passes through a first heat exchange tube aperture of the plurality of rows of first heat exchange tube apertures and is received in the one first elongated aperture.

9. The heat exchanger according to claim 6, wherein the at least one first flow passage comprises at least two first flow passages, a flow area of one of the at least two first flow passages is the same as a flow area of one of the at least one second flow passage; a plurality of first flow passages arranged in parallel with each other, of the at least two first flow passages, is disposed at a same side of the at least one second flow passage; and the middle rib between two adjacent first flow passages of the at least two first flow passages is provided with a hole or opening to communicate the two adjacent first flow passages with each other.

10. The heat exchanger according to claim 5, wherein the second header comprises a third main plate and a fourth main plate; and the third main plate is provided with a recess, and the recess and the fourth main plate enclose a third flow passage.

11. The heat exchanger according to claim 10, wherein each of the at least one first flow passage and each of the at least one second flow passage comprises a first end and a second end, the first end of the at least one first flow passage is located at a same side as the first end of the at least one second flow passage, and the second end of the at least one first flow passage is located at a same side as the second end of the at least one second flow passage;

first partition plates are disposed between the first end and the second end of each of the at least one first flow passage and between the first end and the second end of each of the at least one second flow passage, one of the first partition plates disposed between the first end and the second end of a first flow passage of the at least one first flow passage is configured to partition the first flow passage, and another one of the first partition plates disposed between the first end and the second end of a second flow passage of the at least one second flow passage is configured to partition the second flow passage;

the first end of the first flow passage is in communication with the first end of the second flow passage, the second end of the first flow passage is in communication with a first flow port that is configured to allow a medium to flow therethrough, and the second end of the second flow passage is in communication with a second flow port that is configured to allow the medium to flow therethrough; and the third flow passage comprises two flow channels that are independent from each other, one of the two flow channels is in communication with all heat exchange tubes of the plurality of rows of heat exchange tubes that are in communication with the at least one first flow passage, and the other one of the two flow channels is in communication with heat exchange tubes of the plurality of rows of heat exchange tubes that are in communication with the at least one second flow passage.

12. The heat exchanger according to claim 10, wherein each of the at least one first flow passage and the at least one second flow passage comprises a first end and a second end, the first end of the at least one first flow passage is located at a same side as the first end of the at least one second flow passage, and the second end of the at least one first flow passage is located at the same side as the second end of the at least one second flow passage;

first partition plates are disposed between the first end and the second end of each of the at least one first flow passage and between the first end and the second end of each of the at least one second flow passage, a first partition plate of the first partition plates disposed between the first end and the second end of a first flow passage of the at least one first flow passage is configured to partition the first flow passage, and a first partition plate of the first partition plates disposed between the first end and the second end of a second flow passage of the at least one second flow passage is configured to partition the second flow passage;

the second end of the first flow passage is in communication with a first flow port that is configured to allow a medium to flow therethrough, and the second end of the second flow passage is in communication with a second flow port that is configured to allow the medium to flow therethrough;

the third flow passage comprises a first flow channel, a second flow channel, and a third flow channel, the first flow channel and the second flow channel are partitioned by a second partition plate, the first flow channel and the third flow channel are partitioned by the second partition plate, the second partition plate is located at a side of the first partition plates away from the first flow port, and the second flow channel and the third flow channel are not communicated with each other;

the first flow channel is configured to be in communication with heat exchange tubes of the plurality of rows of heat exchange tubes that are disposed between the second partition plate and the first end of the first flow passage, and to be in communication with heat exchange tubes of the plurality of rows of heat exchange tubes that are disposed between the second partition plate and the first end of the second flow passage;

the second flow channel is configured to be in communication with heat exchange tubes of the plurality of rows of heat exchange tubes that are disposed between the second partition plate and the second end of the first flow passage; and the third flow channel is configured to be in communication with heat exchange tubes of the plurality of rows of heat exchange tubes that are disposed between the second partition plate and the second end of the second flow passage.

13. The heat exchanger according to claim 1, wherein at least one of the first header or the second header comprises a first main plate and a second main plate hermetically connected with each other;

the first main plate comprises a first rib and at least two first curved sections, and the first rib has an end connected to two adjacent first curved sections of the at least two first curved sections and another end attached and connected to the second main plate; and the second main plate comprises at least one second curved section that is arranged to correspond to at least one first curved section of the at least two first curved sections.

14. The heat exchanger according to claim 13, wherein the second main plate comprises a first straight section connected to the at least one second curved section, the at least one second curved section corresponds to the at least one first curved section, and the first straight section is at least partially attached to the first rib.

15. The heat exchanger according to claim 13, wherein the second main plate comprises a first straight section and at least two second curved sections, the first straight section is configured to connect two adjacent ones of the at least two second curved sections, one of the at least two second curved sections corresponds to one of the at least two first curved sections, and the first straight section is attached to the first rib;

the first straight section comprises a first fitting surface, to which an end surface of the first rib is attached; and a first cavity is formed between the first main plate and the second main plate and comprises at least two chambers, and the first rib is located between two adjacent chambers of the at least two chambers.

16. The heat exchanger according to claim 15, wherein the second main plate further comprises a second straight section connected to the at least two second curved sections or the first straight section, and the second straight section comprises a second fitting surface;

the first main plate further comprises a second rib, an end of the second rib is connected with two adjacent ones of the at least two first curved sections, and an end surface of another end of the second rib is attached to the second fitting surface; and each of the at least two chambers comprises at least two sub-chambers, and the second rib is located between two adjacent ones of the at least two sub-chambers.

17. The heat exchanger according to claim 16, wherein at least one of the first rib or the second rib is provided with a third rib, at least one of the first straight section or the second straight section is provided with a fitting aperture, and the third rib is at least partially received and fixed in the fitting aperture; or at least one of the first rib or the second rib is provided with a first through hole, at least one of the first straight section or the second straight section is provided with a second through hole, and at least one of the first header or the second header comprises a first fixing member fixed to and penetrating through the first through hole and the second through hole.

18. The heat exchanger according to claim 16, wherein at least one of the first main plate or the second main plate is provided with partition plate grooves;

the first header further comprises first partition plates;

the first partition plates are fixed to the partition plate grooves;

the first rib is provided with communication grooves; and the at least two chambers are communicated with each other through the communication grooves at a side of each of the first partition plates, and are isolated from each other at another side of each of the first partition plates.

19. The heat exchanger according to claim 16, wherein one of the first rib and the second rib is provided with a third rib, and the other one of the first rib and the second rib is provided with a first through hole; and one of the first straight section and the second straight section is correspondingly provided with a fitting aperture, and the other one of the first straight section and the second straight section is provided with a second through aperture; and at least one of the first rib or the second rib is provided with the first through hole, at least one of the first straight section or the second straight section is provided with the second through hole, the first header or the second header comprises a first fixing member fixed to and penetrating through the first through hole and the second through hole, and the third rib is fixed to the fitting aperture.

20. The heat exchanger according to claim 15, further comprising:

a blocking cap configured to at least block an end of the first cavity, the end cap being disposed at another end of the first cavity without the blocking cap, wherein the end cap has an inlet and an outlet that are in communication with the first cavity.

21. The heat exchanger according to claim 1, wherein the first groove portion is a waist-shaped groove, and the third opening is a circular aperture, a dimension of a major axis of the waist-shaped groove is greater than a diameter of the circular aperture, and a dimension of a minor axis of the waist-shaped groove is configured such that the third opening is capable of communicating the first opening with the second cavity.

* * * * *